US008257150B2

(12) United States Patent
Fujita

(10) Patent No.: US 8,257,150 B2
(45) Date of Patent: Sep. 4, 2012

(54) PAD DRESSER, POLISHING DEVICE, AND PAD DRESSING METHOD

(75) Inventor: Takashi Fujita, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 758 days.

(21) Appl. No.: 12/322,922

(22) Filed: Feb. 9, 2009

(65) Prior Publication Data

US 2009/0221216 A1 Sep. 3, 2009

(30) Foreign Application Priority Data

Feb. 29, 2008 (JP) ..... 2008-049934

(51) Int. Cl.
*B24B 53/00* (2006.01)

(52) U.S. Cl. ..... 451/56; 451/72; 451/443

(58) Field of Classification Search ..... 451/443, 451/444, 56, 72, 21, 5
See application file for complete search history.

(56) References Cited

U.S. PATENT DOCUMENTS

| | | | | |
|---|---|---|---|---|
| 5,885,147 | A | 3/1999 | Kreager et al. | 451/443 |
| 6,623,344 | B2 | 9/2003 | Inaba | 451/443 |
| 6,953,390 | B2 | 10/2005 | Sakurai et al. | 451/56 |
| 7,182,680 | B2 * | 2/2007 | Butterfield et al. | 451/443 |
| 7,670,209 | B2 * | 3/2010 | Fujita | 451/443 |

FOREIGN PATENT DOCUMENTS

| | | |
|---|---|---|
| JP | 10-329003 | 12/1998 |
| JP | 2002-515833 | 5/2002 |
| JP | 2002-273656 | 9/2002 |
| JP | 2003-181756 | 7/2003 |
| JP | 2007-090516 | 4/2007 |
| WO | WO 98/45090 | 10/1998 |

* cited by examiner

*Primary Examiner* — Robert Rose
(74) *Attorney, Agent, or Firm* — Fattibene and Fattibene, LLP; Paul A. Fattibene

(57) ABSTRACT

Elastic member bundled by pencil band is mounted to the lower edge of support part. Elastic member is composed with tungsten wires which are 25 mm in the length and 0.15 mm in diameter bundled with every 30 wires in one bundle. The tip part of each element wire of elastic member contacts polishing pad with the tip end cut round and performs dressing of polishing pad. The wire size of the tip part of each element wire of elastic member is made to be fine and the cutting width on polishing pad is made to be narrow, and at the same time, the rigidity of elastic member is made to be enhanced by bundling each element wire of elastic member with pencil band, and a large pressure is made to be pressed to the fine tip part of each element wire. Therefore, the tip part of elastic member can give an effective incision depth to polishing pad.

10 Claims, 20 Drawing Sheets

Flexible fiber conditioner

Traditional conditioner

DISTINCTION IN PAD CUTTING STATE IN DRESSING

PAD DRESSER, POLISHING DEVICE, AND PAD DRESSING METHOD

BACKGROUND OF THE INVENTION

1. Field of the Invention

The present invention relates to a pad dresser, a polishing device, and a pad dressing method, and in particular, to the pad dresser for reproducing a surface of a polishing pad of the polishing device which polishes a work, such as a semiconductor wafer, the polishing device provided with that, and the pad dressing method.

2. Description of the Related Art

As miniaturization of a semiconductor device and multilayering thereof progress, CMP (Chemical Mechanical Polishing) technology has become an essential technology indispensable to the manufacturing process of the semiconductor device. This CMP technology has been utilized for various processes now, such as not only flattening of an interlayer insulation film but Cu wiring and element isolation.

As one of important specifications in flattening CMP, there is an in-surface uniformity of a work (polishing uniformity) of a removal rate. In order to enhance the polishing uniformity, it becomes important to distribute uniformly factors which influence the removal rate in the in-surface of the work.

While there is polishing pressure, relative velocity of the polishing, etc. as the important factors, there is a surface state of the polishing pad as the important factor of which the quantification has not progressed conventionally. The desirable surface state of the polishing pad is formed with the pad dressing. Therefore, for example, also from the fact that the removal rate abruptly falls when the pad dressing is suspended in so-called an in-Situ dressing in which the pad dressing is simultaneously performed in the midst of polishing, it is also clear that the strict control of the surface state of the polishing pad is important.

The pad dressing means that by making the pad dresser ("dresser" may just be called henceforth) to which grindstones such as a diamond are attached abut the polishing pad, and cutting the surface of the polishing pad or roughening the surface, etc., the retentivity of slurry is made to be good to initialize the pad into a polishable state, and the retentivity of slurry is made to recover for the polishing pad in use, and the polishing capability is made to be maintained.

As the pad dresser, the dresser in which a diamond abrasive grain is electrodeposited is used conventionally, and in many cases, used is the dresser which is made to rotate in the surroundings of an axis and made to be pressed on the polishing pad and performs dressing of the polishing pad (for example, refer to Japanese Patent Laid-Open Publication No. 2001-274122 or Japanese Patent Laid-Open Publication No. 2003-181756).

FIG. 18 is a conceptual diagram for describing the pad dresser described in Japanese Patent Laid-Open Publication No. 2001-274122. As for pad dresser 130 described in Japanese Patent Laid-Open Publication No. 2001-274122, as shown in FIG. 18, substrate 131 on which diamond abrasive grains 133, 133, . . . , are electrodeposited is fixed and attached to support part 132.

FIG. 19 is a conceptual diagram for describing the pad dresser described in Japanese Patent Laid-Open Publication No. 2003-181756. Pad dresser 130A described in Japanese Patent Laid-Open Publication No. 2003-181756, in principle as shown in FIG. 19, is composed so that substrate 131A on which diamond abrasive grains 133, 133, . . . , are electrodeposited is attached swingably in all directions to support part

132A via a so-called gimbaled structure such as ball joint 132*a*, for example, and follows the surface of polishing pad 20.

What is provided with a brush dresser besides a diamond dresser is known (for example, refer to Japanese Patent Laid-Open Publication No. 2003-211355). The diamond dresser which is a first dresser cutting the polishing pad surface and a second dresser for scraping out the debris stuffed up in a concave portion of the polished surface of the polishing pad are disclosed.

Since the brush dresser makes it the object to scrape out the debris stuffed up in the concave portion of the polished surface, the diamond dresser which is the first dresser bears the dressing with regard to the so-called pad dressing cutting the pad.

A nylon brush is used as a material used in the brush dresser. However, although the nylon brush has an ability to brush the pad surface, the brush has no effect of cutting off the pad surface.

Here, an investigation which ascertains an effect of the pad dressing was performed in advance of the present invention. First, the polishing pad surface is brushed with the nylon brush, supplying pure water without cutting the polishing pad surface, and the recovery of the removal rate in the polishing pad which was made to be clogged was evaluated. However, in spite of prolonged pure-water feed and brushing, the recovery of the removal rate was at most only 31.4%. At this time, SEM observation of the polishing pad surface was performed and it was confirmed that the debris of the polishing pad surface was removed finely. [Related literature: Daichi Kamikawa and Takashi Fujita, et al., the transaction of the symposium in Tohoku Branch Office of the Japan Society for Precision Engineering, p22, 2004]

This experiment has clarified that just only removing the debris staying on the surface of the polishing pad by brushing does not mean having performed the pad dressing. After this experiment, by performing the usual diamond dressing process that cuts the polishing pad surface, the recovery of the removal rate has been confirmed, and it is concluded that there is the need of cutting off the polishing pad surface for performing the pad dressing. In addition, in the case of brushes made of resin, such as nylon, when cutting the pad made from polyurethane which is the same resin material, since it is the same resin material, both sides are similarly worn out and decay, and it is easily understandable for one skilled in the art that cutting the pad will not be realized thereby.

In addition to this, in the removal rate lowering process according to the clogging on the polishing pad, it is also shown clearly that reforming of the surface of the polishing pad is performed chemically. Thus, it is concluded that being reformed chemically like this is also one factor that reduces the removal rate. [Related literature: Takashi Fujita et al., the transaction of the symposium in the spring convention of the Japan Society for Precision Engineering, p 845, 2005]

Therefore, in the pad dressing, because there is the effect according to the reforming of the polishing pad itself, except for the effect of the removal rate reduction caused by the concave stuffed up on the surface of the pad, it can be understood also from such cases that the polishing pad must be cut in order to recover the pad state completely.

From the situations mentioned above, the inventor of the present invention has clarified that the effect of scraping out the debris of the polishing pad surface is insufficient as the dressing for maintaining the removal rate, and cutting off the reformed pad surface is indispensable.

The pad dressing is often used mixing with the pad brushing. However, in consideration of such cases, the pad dressing is defined here as follows as contrasted with the pad brushing. The pad dressing is made to be defined as the process which keeps the pad state uniform by roughening the surface with cutting the pad physically. On the other hand, the pad brushing is made to be defined as the process for removing, without cutting, grinding waste etc. which are included in the concave of the pad. Both are clearly distinguished even in the functional aspect by whether cutting off and removing physically the reformed pad surface itself or not.

Therefore, in the disclosed technologies, there is no content of performing the dressing in which the pad surface is cut off with the brush, and they are used consistently as the means for removing debris which are staying on the pad surface.

In addition, disclosed is the technology which describes the dressing using a brush (for example, refer to Japanese Patent Laid-Open Publication No. 2003-181756 or Japanese Patent Laid-Open Publication No. 10-329003). However, the brush dressers given in Japanese Patent Laid-Open Publication No. 2003-181756 and Japanese Patent Laid-Open Publication No. 10-329003 as well as in Japanese Patent Laid-Open Publication No. 2003-211355 are descriptions as the brushing method for scraping out the debris on the polishing pad, and are not the dressing for cutting off the surface of the polishing pad.

As a technology describing the dressing using the brush, the configuration which uses comparatively high rigidity materials, such as a metal wire, is shown as a polishing adjusting element (here, dresser) in order to give a texture to a polishing web (Japanese PCT National Publication No. 2002-515833).

However, in Japanese PCT National Publication No. 2002-515833, the polishing web is pulled and adjusted with a rolling turn bar, and the pad surface is adjusted against the polishing web stretched. In such a case, the dressing on the reference of the fixed-supported pad surface is not performed. It is because the pressure of the dressing involves various factors, such as the tension of the pad.

As a technology which describes the dressing using a brush similarly, the method in which the surface of the surface-roughening member which is supported by the flexible material performs dressing with following the undulation of the pad and contacting thereto is described. An embodiment which uses a brush as the surface-roughening member is also described (Japanese Patent Laid-Open Publication No. 10-315117).

However, in Japanese Patent Laid-Open Publication No. 10-315117, the portion which fixes the surface-roughening member and the flexible material is attached to an adjustment arm by a pin hinge. That is, even if the brush is used, the point group operates as one surface as a whole. Since the overall brush chamfer cants against the pad surface according to the frictional force received by brush chamfer, the intermittent contact to the pad by the dresser stated previously cannot be avoided as a result. Therefore, the surface reference dressing on the reference of the pad surface is not realizable. From the description that this is compatible with the diamond type as the surface-roughening member, the brush taken up here is only what has the function which performs surface-roughening of the pad to the last, and it can be also understood easily that it is not what has the dressing function on the reference of the pad surface.

A method for performing the dressing of the pad surface in double-sided polishing using a brush is shown (Patent documents 7). However, since it is stated that the hard brush to such an extent of no buckling distortion is used as the configuration of the brush and the method is not what allows elastic deformation of the brush, the method does not make the surface reference dressing possible either.

A brush dresser for eliminating a concave portion of the surface of the polishing pad is shown (Patent documents 8). However, since eliminating the concave portion of the pad surface is described, it is not what performs the dressing along the shape of the pad surface. Since the dresser (FIG. 12) of the brush is described as compatible in terms of parallel as the diamond type dresser (FIG. 10) and the ceramics dresser (FIG. 11), just providing a convex-concave shape on the dresser surface and cutting off the surface of the polishing pad by the dresser having such the surface shape, are considered to be the purpose.

In this, the configuration and the method of performing dressing uniformly on the reference of the pad surface by the elastic deformation of the material are not suggested, and a dressing method which corrects the surface flatly is shown.

Further, as a dressing method with respect to a grinding stone, a dresser which is formed by kneading a super-hard abrasive grain in a nylon brush is shown (Japanese Patent Laid-Open Publication No. 2002-273656).

Since it is the dressing for the grinding process, the hard abrasive grain kneaded into the nylon brush is dropped when performing dressing and the growing wild of the dresser itself is assumed. When used for flattening etc. of a semiconductor wafer stated in this case, if the diamond abrasive grain drops in the case of the dressing, for example, the abrasive grain will be put between the polishing pad and the wafer, and a fatal scratch will be given on the wafer surface. Therefore, the dresser which causes falling of the abrasive grain is excluded from the specifications which are the prerequisite as a dresser for polishing of the semiconductor wafer.

A dressing method which performs a surface reference dressing on the reference of the surface of the polishing pad is shown (Japanese Patent Laid-Open Publication No. 2007-90516).

However, in Japanese Patent Laid-Open Publication No. 2007-90516, if the wire size of the wire rod is made thick in the case of each wire type member operates independently, the rigidity will become large. However, when the wire size is thick, the effective incision depth cannot be given on the pad. Even if the effective incision depth can be given on the pad by excessive force, since the minimum amount with which the pad is cut will become large, the situation where the pad surface is plucked rather than cut and roughened arises.

In a pad dressing, the plucking a pad surface leads to plucking a hydration sphere which includes slurry etc. moderately in the pad surface, and the retentivity of slurry on the pad surface may be made to get worse on the contrary. The hydration sphere holding the slurry, depending also on the material of the pad, is about few-dozens μm order in the case of the foaming polyurethane. Even if cutting off is performed within that, the minimum amount volume of the cutting off where the hydration will continue to be maintained is from several micrometers to about ten micrometers. Therefore, in the case of the dresser which uses the thick wires, it is difficult to roughen the pad with cutting the pad finely.

On the other hand, if each wire rod is made fine, it will be considered possible to roughen the pad finely. However, when each wire rod is made fine, since the bending rigidity of each wire rod becomes small, there is not rigidity of the wire rod to the extent that the effective incision depth is obtained, and it becomes difficult to perform the dressing itself which roughens the pad surface with cutting off thereon.

Even if the dresser has the wire size to the extent that cuts and roughens the pad finely, there is a problem of the abrasion of the tip part next. Although sufficient rigidity to the extent of cutting the pad surface is secured with the wire rod of about 0.25 mm in wire size for example, there is a problem of the abrasion of the tip part. Usually, in the case of that a high hardness material like the diamond is used as the abrasive grain, it is possible for the sharpness at the tip of the abrasive grain to secure a certain amount of processing time, and the capability to cut the pad is stabilized in the time frame. However, it is extremely difficult to attach the diamond abrasive grain at the tip of the fine wire rod like 0.25 mm by electrodeposition etc. Therefore, it is desired to perform dressing by the tip part of the wire rod itself. However, in the case of that the dressing is performed by SUS of a metallic material, etc., for example, since the abrasion resistance is extremely low compared with the diamond etc., the tip part blunts immediately. As a result, the continuation of cutting and roughening of the pad itself became impossible with the blunting, and it was extremely short-lived.

From the above, there has been the problem in which even if a fine wire rod about 0.25 mm of a wire size is used, the time frame which can be used substantially is extremely short by the progress of the blunting of the tip Further, in the case of that a plurality of element wires are simply bundled together, and the vicinity of the tip part is all constrained like the upper part altogether, there is the problem where the effective amount of incision cannot be given. This is because, although the tip part operates as an individual point, if the tip part exists very densely, the pressure which one tip point extends on the pad abruptly decreases even if the tip point is individual. In an extreme case, in the case of bundling a plurality of element wires in very high density and without any gap therebetween, the tip parts of the element wires are considered to operate as one surface instead of the individual tip point. As the result, it becomes impossible to give effective incision for cutting the pad, and it becomes impossible to perform the pad dressing of roughening the pad with cutting off thereon.

By the way, since a polishing pad used with CMP device has thickness unevenness of the polishing pad itself, and attachment unevenness to the polishing surface plate, the polishing pad surface after the attachment thereon is not planar. The polishing pad surface after the attachment usually has a vertical interval (ups and downs) of an undulation (about 30 μm to 50 μm).

However, in CMP, in order to polish a in-surface of a wafer uniformly, it is required to perform dressing uniformly (following) following the surface of ups and downs also on the polishing pad surface which has such ups and downs.

FIG. 20 is a diagram showing a concept of a specification of a pad dressing required of CMP. As shown in FIG. 20, in the case of performing dressing of the polishing pad 20 in which the undulation is formed in about 100 mm in the width and in about 50 μm in the vertical interval, for example, it is required to perform dressing uniformly with following the undulation. Thus, since the polishing pad is an elastic material, the pad dressing in CMP device can be regarded as a surface reference grinding process of the elastic material.

However, pad dresser 130 described in the above-mentioned Japanese Patent Laid-Open Publication No. 2001-274122, since the dresser (namely, substrate 131 on which diamond abrasive grains 133, 133, . . . , are electrodeposited) is completely fixed to support part 132 as shown in FIG. 18, only the convex portion of the undulation of the polishing pad surface will be cut off. Therefore, there is a problem that the uniform dressing along the polishing pad surface is not performed.

As shown in FIG. 19, although pad dresser 130A described in the above-mentioned Japanese Patent Laid-Open Publication No. 2003-181756 is supported so that the dresser surface may follow the surface of polishing pad 20, in a actual pad dressing, the dresser cannot follow the polishing pad surface, and cannot perform dressing uniformly. It is because the pad dresser cants against the polishing pad 20 since a large frictional force works on the pad dresser surface in contact with polishing pad 20 which is moving in a high speed. Since the pad dresser returns to the original attitude when the friction is reduced with the pad dresser canted, as a result, the pad dresser will contact polishing pad 20 intermittently (stick slip).

Dispersion (ununiformity) in the dressing in the in-surface of such polishing pad 20 causes the following problems against the polishing performance on a wafer. First, since the portion where the dressing is performed in the in-surface of the polishing pad and the portion where the dressing is not performed therein, are intermingled, the polishing unevenness (polishing dispersion) is generated in the in-surface of the wafer. Next, in a process step of starting polishing the pad, since the dressing of the whole surface is not performed uniformly but the dressing area expands gradually, it takes time for the removal rate to be saturated. Since the one whose removal rate is not saturated cannot be used for the product processing, the rise time of the polishing pad becomes long as a result.

Further, in the case of performing dressing of the polishing pad using the traditional diamond electrodeposition plate, the overall pad dresser system will repeat intermittent contact according to the mode where the pad dresser cants by the frictional force when the polishing pad performs high-speed motion and returns to the original attitude after that, as mentioned above. Although the dressing dispersion of the circumferential direction of the polishing pad mentioned above is caused by this phenomenon, the problem is not restricted only to this.

Also about the volume of the polishing pad swarf removed with the pad dressing, while the pad dresser does intermittent contact, the portion which can be cut off greatly, and the portion which can be cut off a little are intermingled, and dispersion in the volume of swarf becomes large. Since the polishing pad will be cut off with being exfoliated greatly as a result without the polishing pad surface being cut off finely and stably, the amount of the abrasion wear of the polishing pad abraded out by the pad dressing becomes large. As a result, the life of the polishing pad became short and the problem that the exchange cycle of the polishing pad is brought forward has also arisen. From such mentioned above, the traditional pad dresser holds the essential structural problems from the viewpoint of the surface reference grinding of an elastic body.

Further, in the traditional surface reference dressing mechanism, since the mechanism will perform dressing so that the surface of the polishing pad may be followed using a plurality of elastic members, the following various problems arise.

That is, in the case of mounting an abrasion-resistant material (for example, diamond abrasive grain) of high hardness to the tip part of the elastic member, the abrasion-resistant material (diamond abrasive grain) may drop with the friction at the time of the pad dressing. The technical difficulty of mounting the abrasion-resistant material with the sufficient accuracy to the tip part of the elastic member of the fine wire size is high, and the cost of the polishing device will become high as a result.

Further, in the case of using metallic materials etc. without using the abrasion-resistant material for the tip part of the elastic member, there arises such problem as the tip part has been immediately worn out, and the replacement frequency of the pad dresser will become fast extremely.

As elastic material of the pad dresser, a preferred material which has sufficient abrasion resistance with having proper elasticity against the dressing is required in order to follow the ups and downs of the surface of the polishing pad, and at present, such preferred material has not ever existed.

When the tip part of the elastic member is abraded out, the pad dressing capability abruptly decreases, and there is a possibility of causing remarkable lowering of the removal rate. As the result, when compared with the diamond dresser of a traditional disk type, there exists such problem as the elastic material cannot bear usage because the dresser replacement frequency thereof is high.

Accordingly, in order to enable it to use without replacing during a long period of time while having the proper elasticity for performing the dressing on the reference of the surface of the polishing pad, the technical subjects to be solved will come to arise, and the present invention makes it the object to provide the pad dresser and the polishing device that solve the subjects.

SUMMARY OF THE INVENTION

The present invention provides a pad dresser according to an embodiment of the invention in order to attain the object mentioned above in the pad dresser which roughens and processes a surface of a polishing pad used for a polishing device which polishes a work, and the pad dresser comprises:

an elastic member which comprises a plurality of element wires having a tip part which cuts the surface of the polishing pad;

a support part which is fixed and supported so as to support a foundation part of the elastic member and so as to be opposed to the polishing pad and nearly parallel therewith; and constraint means which constrains the elastic member so as to restrain an elastic deformation thereof, wherein the support part moves relatively against the polishing pad and the tip part of the elastic member is made to abut the polishing pad, and the elastic member performs elastic deformation, and thereby the tip part is made to be pressed on the surface of the polishing pad by a predetermined pad dressing pressure, and the pressed elastic member cuts the surface of the polishing pad, and the dressing of the polishing pad is performed uniformly along with the shape of the surface of the polishing pad.

According an embodiment of the present invention, although a plurality of element wires which compose the elastic member are formed with very fine wire rods, the proper deflection rigidity can be given to the elastic member by the constraint means. By this, the elastic member can polish the polishing pad properly. Generally, when composing the elastic member with the very fine wire rods bundled together, the sufficient dressing pressure can not be given to the polishing pad, and therefore the effective incision depth to the extent of cutting the polishing pad cannot be given. In traditional technologies, when the tip part of the pad dresser becomes blunt, the tip part only scrub flatly the surface, and therefore it is impossible to cut the polishing pad with giving the effective incision depth thereon.

However, by the pad dresser according to an embodiment, the elastic deformation part of the elastic material which comprises a plurality of element wires performs elastic deformation under the state where the pad is fixed and supported on the platen, the tip part of the elastic material contacts the surface of the pad so as to follow the undulation of the surface of the pad. The tip part becomes able to perform dressing on the reference of the pad surface as a result by having the function to cut and roughen the pad.

Conventionally, there was a case where a fine element wire was used from the purpose of cutting off and roughening finely the pad surface. However in this case, the rigidity of the elastic deformation part reduced extremely and it was impossible for the tip part of the elastic material to roughen the surface of the pad with cutting off the surface thereof. However, even if each element wire is fine, it becomes possible to obtain the sufficient elastic strength as the overall elastic member by composing the elastic member with bundling a plurality of the fine element wires together. Thereby, the following specific operation effects can be provided. That is, since each element wire of the elastic member is made of the fine wire rod, the fine wire rod also at the tip part abuts the polishing pad. At this time, since the elastic material does not have the abrasion resistance like a diamond, it blunts immediately. However, even if the tip part is blunted, since very large bending rigidity can be acquired by bundling the elastic member together, the amount of incision for cutting the polishing pad can fully be obtained. As the result, it becomes possible to perform stable pad dressing regardless of blunting at the tip of each element wire composing the elastic member.

The invention according to another embodiment provides a polishing device which polishes a work, and the polishing device comprises: a pad fixed and supported on a platen; a wafer holding mechanism for holding a wafer; and a dresser for dressing a surface of the pad, the dresser further comprises: an elastic member including a plurality of element wires having a tip part for cutting a surface of the polishing pad, the elastic member further comprises: a support part fixed and supported so as to be nearly parallel with the polishing pad and opposed thereto; the tip part abutting the pad and cutting and roughening the surface of the pad; and an elastic deformation part for the tip part to follow the surface of the pad and contact the pad with a constant pressure, the elastic deformation part further comprises: an effective length for performing the elastic deformation; and constraint means for constraining so as to restrain the elastic deformation with respect to the elastic deformation part of the one or more elastic members, wherein the support part moves relatively against the polishing pad, and at the same time, the tip part of the elastic member is made to abut the polishing pad and the elastic member performs elastic deformation, and thereby the tip part is pressed on the surface of the polishing pad by a predetermined pad dressing pressure and the pressed elastic member cuts the surface of the polishing pad, and at the same time, dressing of the polishing pad is performed uniformly along the shape of the surface of the polishing pad.

According to this configuration, the same operation as the invention according to another embodiment is provided.

In the invention according to another embodiment, the constraint means constrains the elastic member so that the tip part which contacts the polishing pad may be released in the restrained condition compared with the upper part.

According to such a configuration, a proper deflection rigidity force can be given to the elastic deformation part of the elastic member, and the tip parts of the elastic member contacting the polishing pad can obtain properly the amount of incision for cutting the polishing pad by having proper gaps mutually.

In the invention according to another embodiment, the constraint means has realized the restraining condition by bundling together or twisting a plurality of element wires of the elastic member.

According to such a configuration, by bundling together or twisting a plurality of element wires which compose the elastic member, it is possible to acquire the proper bending rigidity by making the fine element wires unify, and at the same time, by releasing the twist, the proper gaps are given between the tips mutually at around the tip part and the proper amount of incision can be given on the polishing pad.

In the invention according to another embodiment, a plurality of element wires of the elastic member are formed with the wire rod of metallic material.

According to such a configuration, since the elastic member is composed by bundling metal wires, such as a tungsten wire, for example, the optimal incision amount can be given on the polishing pad with proper bending rigidity.

In the invention according to another embodiment, a plurality of element wires of the elastic member are characterized by each wire size being 0.025 mm or more and 0.2 mm or less.

That is, when the wire size of the element wire is between 0.025 mm and 0.2 mm in diameter, corresponding to that, the diameter of the tip part also becomes small. Therefore, since the cutting width which is cut on the polishing pad is narrow enough as compared with the traditional diamond dresser, the fine cutting can be performed on the polishing pad. The deflection rigidity of the overall elastic member can be enlarged by bundling the wire rods of the wire size of the above-mentioned range, and even in the case of the fine tip, the sufficient incision depth (pad cut amount) can be given on the polishing pad.

In the invention according to another embodiment, the pressure regulation means to adjust the pad dressing pressure by adjusting the deflection amount of the elastic member with making the support part move with contact and non-contact against the polishing pad, is provided.

According to such a configuration, since the pressure regulation means to adjust the pad dressing pressure with adjusting the deflection amount of the elastic member is provided, the pad dressing can be performed on the optimal pressing conditions.

The invention according to one embodiment provides the polishing device provided with the pad dresser according to any one of the other embodiments.

According to the invention of another embodiment, since the polishing device provided with the pad dresser capable of the uniform pad dressing along the surface of the polishing pad is realized, the good polishing process which is excellent in the uniformity of the removal rate of the in-surface of the work can be performed.

The invention according to one embodiment provides a pad dressing method. In the pad dressing method which roughens and processes the surface of a polishing pad used for a polishing device which polishes a work, the pad dresser according to any one of the other embodiments is used, and a relative motion of a polishing pad and the pad dresser is performed with making the pad dresser abut the polishing pad, and a pad dressing is performed with supplying pure water or slurry.

According to the invention of another embodiment, since the tip part of the elastic member is made to abut the polishing pad, the dressing pressure is generated by making the elastic member elastically deform and the dressing is performed by the tip part of the elastic member, the tip part can follow the polishing pad surface and the uniform pad dressing along the polishing pad surface can be performed.

According to another embodiment of the invention, although a plurality of element wires composing the elastic member are formed with the very fine wire rods, the proper deflection rigidity can be given to the elastic member by the constraint means. By this, the elastic member can polish the polishing pad with the proper rake angle. As a result, the uniform pad dressing along the surface of the polishing pad becomes possible, and the good polishing process which is excellent in uniformity of the removal rate of the in-surface of the work can be performed.

The invention according to one embodiment provides the same effect as the invention according to another embodiment.

According to another embodiment of the invention, since the proper deflection rigidity force can be given to the overall elastic member, and the tip part of the elastic member in contact with the polishing pad cuts the polishing pad with proper bending rigidity, the incision amount can be properly obtained.

According to another embodiment of the invention, since the optimal bending rigidity can be acquired by bundling together or twisting a plurality of element wires which compose the elastic member, the elastic member becomes able to give the proper amount of incision on the polishing pad.

According to another embodiment of the invention, by using a plurality of metal wires for the elastic member, the optimal bending rigidity can be given thereto only by bundling together or twisting the metal wire. Therefore, the proper amount of incision can be given on the polishing pad by using such elastic member.

According to another embodiment of the invention, while the wire sizes of a plurality of element wires which compose the elastic member are between 0.025 mm and 0.2 mm in diameter, the fine cutting can be performed on the polishing pad. The deflection rigidity of the overall elastic member can be enlarged by bundling the wire rods of the wire size of the above-mentioned range, and even in the case of the fine tip part, a sufficient incision depth can be given on the polishing pad.

According to another embodiment of the invention, since the pad dressing pressure is adjusted optimally with adjusting the deflection amount of the elastic member and, it becomes possible to perform the pad dressing on good conditions.

According to another embodiment of the invention, since the uniform pad dressing along the surface of the polishing pad is possible, the good polishing process which is excellent in uniformity of the removal rate of the in-surface of the work can be performed.

According to another embodiment of the invention, the tip part of the elastic member can follow the surface of the polishing pad, and the uniform pad dressing along the surface of the polishing pad can be performed.

BRIEF DESCRIPTION OF THE DRAWINGS

FIG. 9 is a conceptual diagram of a pad dresser according to the first embodiment of the present invention, where

FIG. 11 is a conceptual diagram of a pad dresser according to a second embodiment of the present invention, where

FIG. 12 is a conceptual diagram of a pad dresser according to a first of a third embodiment of the present invention, where

FIG. 14 is a conceptual diagram of the pad dresser according to a third of the third embodiment of the present invention, where

DETAILED DESCRIPTION OF THE PREFERRED EMBODIMENTS

In order to attain the object of enabling a pad dresser to be used without replacing during a long period of time with having the proper elasticity for performing dressing on the reference of the surface of a polishing pad, the present invention comprises an elastic member composed with a plurality of element wires having a tip part which cuts the surface of the polishing pad in the pad dresser which roughens and processes the surface of the polishing pad used for the polishing device which polishes a work. The elastic member has a base end, an elastic deformation part, and the tip part. A foundation part of the elastic member is supported and has the support part which is fixed and supported so as to be nearly parallel with the polishing pad and opposed thereto. The tip part has a function to cut off the pad surface. There exist the elastic deformation part between the tip part and the base end. The elastic deformation part has constraint means for constraining so as to restrain the elastic deformation. The pad dresser is configured so that the support part moves relatively against the polishing pad and the tip part of the elastic member thereof is made to abut the polishing pad, and the tip part is pressed on the surface of the polishing pad by a predetermined pad dressing pressure with the elastic member deformed elastically, and the pressed elastic member cuts the surface of the polishing pad and the dressing of the polishing pad is performed uniformly along the shape of the surface of the polishing pad. The present invention has been realized by providing the pad dresser of such a configuration.

Hereinafter, referring to FIG. 1 to FIG. 20, prerequisite technologies of the pad dresser and the polishing device according to the present invention are described first for facilitating the understanding thereof, and after that, a preferred embodiment according to the present invention is described in detail. In each Figure, the same number or the same numeral will be given to the same member or the same component.

Figure 1:
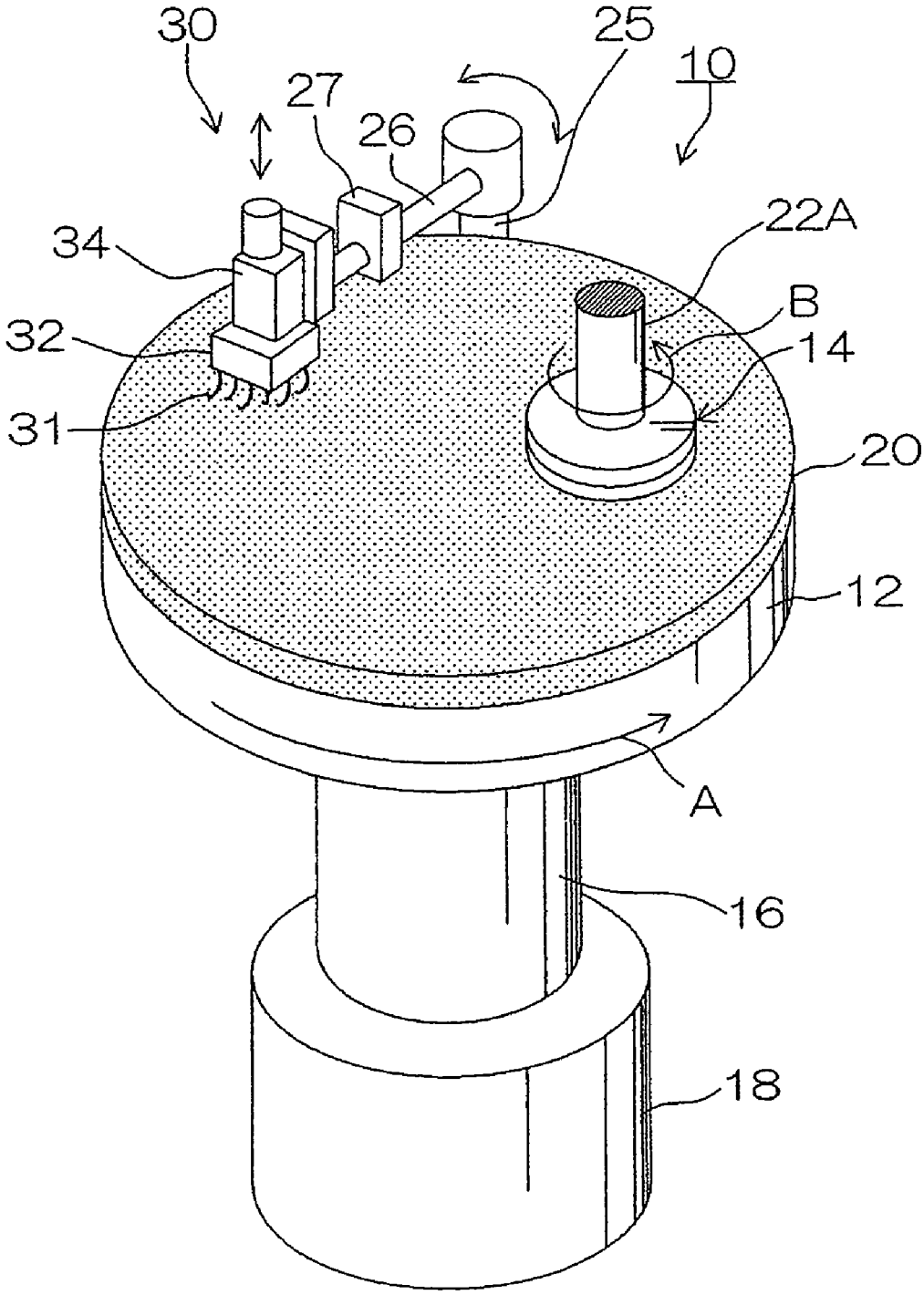
FIG. 1 is a perspective view showing a polishing device according to an embodiment of the present invention.

FIG. 1 is a perspective view of a polishing device according to an embodiment of the present invention. Polishing device 10 shown in FIG. 1 mainly comprises polishing surface plate 12, wafer carrier 14, and pad dresser 30.

Polishing surface plate 12 rotates in the direction of arrow-head A of FIG. 1 by driving motor 18 connected with revolving shaft 16. Wafer carrier 14 holding the wafer which is a work is driven by a not shown motor connected with revolving shaft 22A, and rotates in the direction of arrow-head B. Polishing pad 20 is attached on the upper surface of polishing surface plate 12, and slurry is supplied on polishing pad 20 from a not shown slurry supply nozzle.

Pad dresser 30 is pressed against the surface of rotating polishing pad 20, and eliminates clogging of polishing pad 20 and roughens the pad surface with cutting off the surface thereof, and performs dressing for making the retentivity of slurry recover and for making the pad maintain the polishing capability.

FIG. 2 is a conceptual diagram of pad dresser 30 of a first prerequisite technology according to the present invention. Pad dresser 30 comprises elastic member 31 and support part 32 which mainly supports base end 31*a* of elastic member 31. Support part 32 is supported by pressure regulation means 34 which moves repeating contact and non-contact on polishing pad 20.

As elastic member 31, the aggregates (for example, brush-like aggregate), such as stainless steel, duralumin, brass, and wire-like metallic material of high modulus and high hardness abrasion resistance are used preferably.

As for each tip part 31*b* of elastic member 31, it is preferred to be formed in sharpness shape and to be covered by the high hardness abrasion resistance material.

As for the high hardness abrasion resistance material, DCL (Diamond Like Carbon) and a superhard, etc. other than the diamond abrasive grain can also used, and as fixing method, CVD (Chemical Vapor Deposition)and a method by coating, etc. besides plating of electrodeposition etc. can also be used.

Figure 2A:
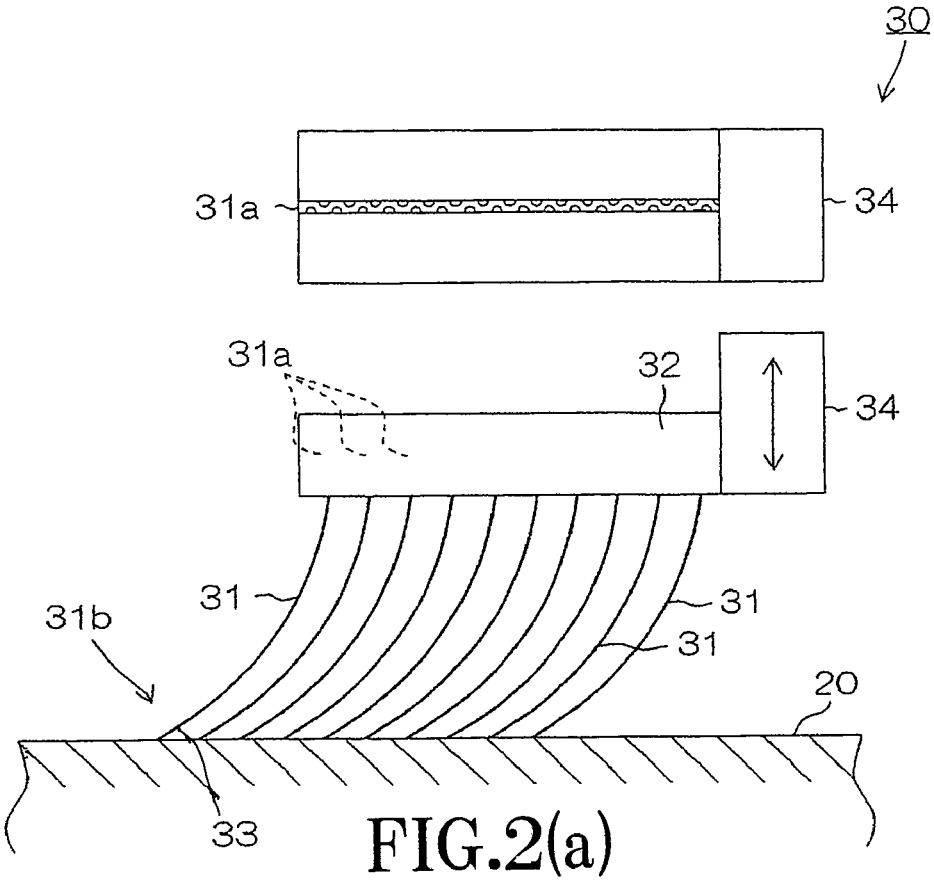
FIG. 2 is a conceptual diagram of pad dresser 30 of a first prerequisite technology according to the present invention.

As for support part 32, shown in FIG. 2A, various fixing methods such as a method which sandwiches base end 31*a* of elastic member 31 with two members, a method holding by adhesion, or a method which provides support part 32 fixing holes and plants several at a time therein, etc. can be adopted. Pressure regulation means 34 can be constructed from a not shown guide member and screw members etc. driven by a motor, but other drive mechanisms can also be used.

Figure 7:
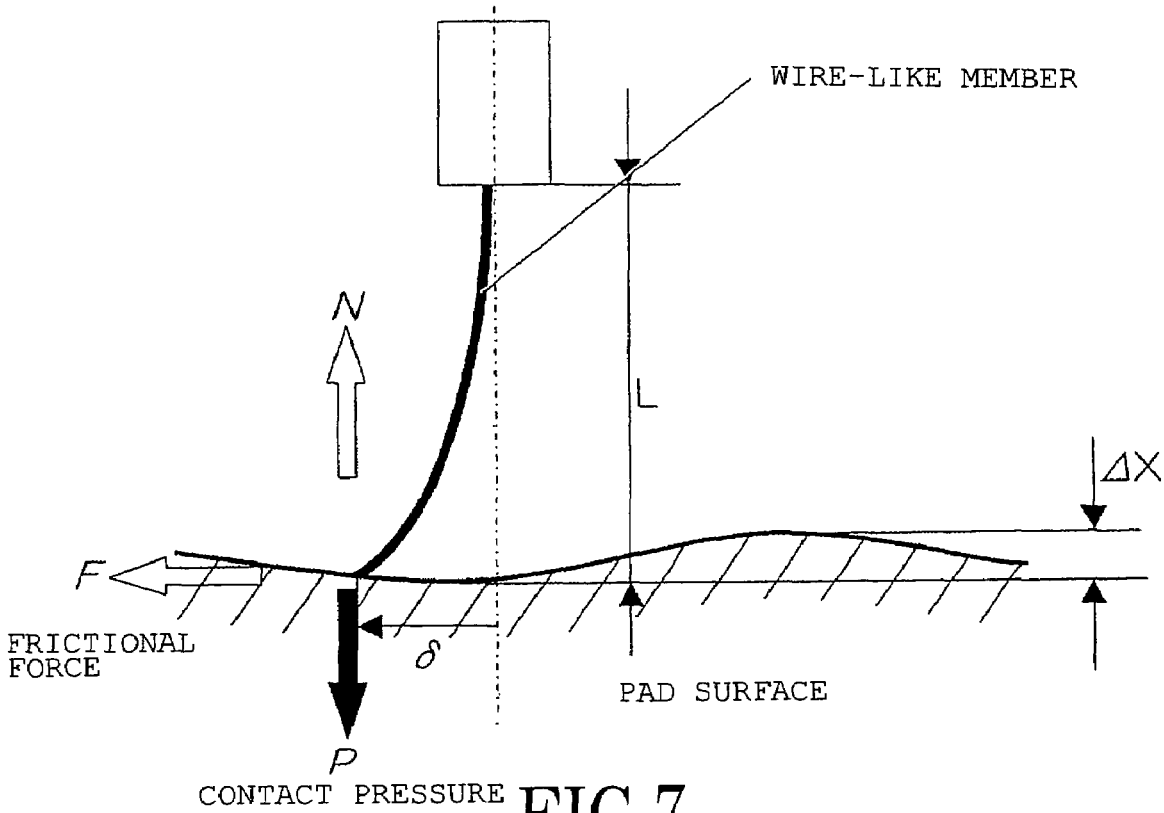
FIG. 7 is a dressing schematic view in accordance with pad dresser 30 of FIG. 2.

FIG. 7 is a dressing schematic view according to pad dresser 30 of FIG. 2. In the case of Young's modulus of elastic member 31: E, the effective flexible length of elastic member 31: L, the thickness of elastic member 31: t, the width of elastic member 31: b, the friction coefficient between elastic member 31 and polishing pad 20: μ, and the displacement in the deflection horizontal direction of elastic member 31: δ, the dressing pressure P is expressed with the following formula (1).

$$P=Ebt^3\delta/6(\delta^2+L^2)(\mu L+\delta) \quad (1)$$

For example, when the undulation of the surface of polishing pad 20 is ±50 μm, in the case of that elastic member 31 having the properties: Young's modulus E=101 Gpa; t=0.4 mm in thickness; b=0.3 mm in width; and the effective len3gth of L=30 mm is used, the dressing pressure P=20±0.076 gf, and the pressure dispersion according to height dispersion of polishing pad 20 is about 0.4% or less.

In addition to the traceability by elastic member 31 against the surface of polishing pad 20, if abrasive grains supported by elastic member 31 are made to displace and move independently, respectively, the continuous and stabilized operation on polishing pad 20 comes to be performed on the average.

In FIG. 2, when performing the dressing of the polishing pad 20, from the state where tip terminal 33 of pad dresser 30 is made to abut the surface of rotating polishing pad 20, support part 32 is made to close with polishing pad 20 by specified quantity and elastic member 31 is made to be bent thereby. Elastic member 31 performs elastic deformation in this way, and the dressing pressure is created thereby and the dressing of the surface of polishing pad 20 is performed. Thus, the optimal dressing pressure can be obtained by adjusting the deflection amount of elastic member 31 with pressure regulation means 34.

Tip terminal 33 follows the vertical interval according to the undulation of the surface of polishing pad 20, and the dressing can be uniformly performed along the surface of polishing pad 20, because the stress variation value corresponding to the change amount of the deflection amount of elastic member 31 according to the following is small.

Since elastic member 31 is formed with the aggregate of which members are independent respectively, even if tip part 31*b* of each elastic member 31 performs intermittent contact respectively in terms of stick slip against polishing pad 20, as the overall aggregate of a plurality of elastic members 31, 31, . . . , some of the tip part of 31*b*, 31*b*, . . . of a plurality of elastic members 31, 31, . . . always contacts polishing pad 20, and the uniform pad dressing along the surface of polishing pad 20 is possible.

As shown in FIG. 1, pad dresser 30 is fixed to revolving shaft 25 and is attached to arm 26 which is provided with moving mechanism 27, and pad dresser 30 is made to perform reciprocation movement between a center section and a peripheral edge part of polishing pad 20, or elastic member 31 is made to be disposed in the state of standing in line in the radial direction of polishing pad 20 and is made to perform reciprocation movement in the radial direction of polishing pad 20 by moving mechanism 27, and the uniformity of the dressing of the in-surface of the polishing pad can be enhanced by performing the pad dressing thereby.

Figure 3:
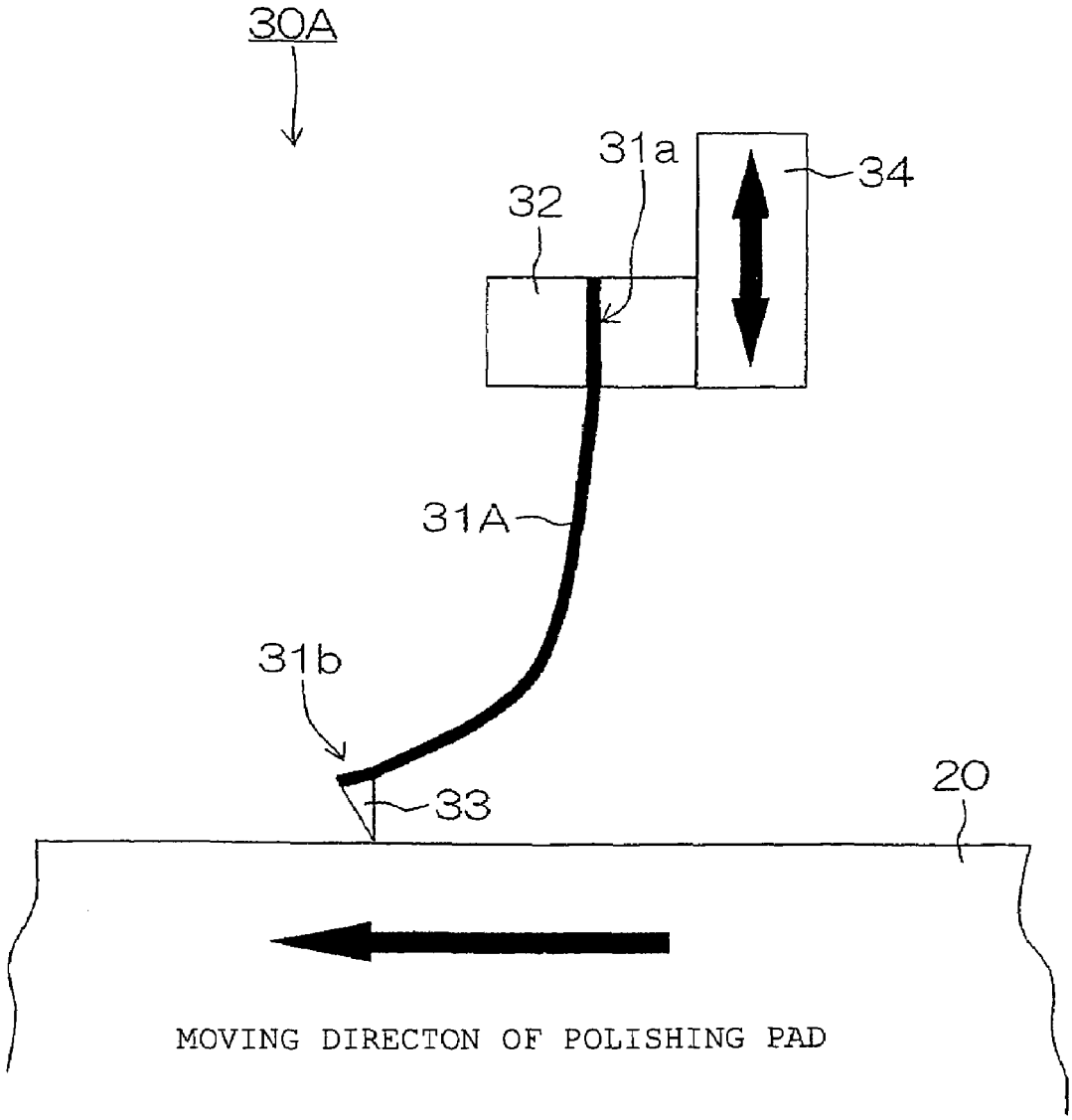
FIG. 3 is a conceptual diagram of pad dresser 30 of a second prerequisite technology according to the present invention.

FIG. 3 is a conceptual diagram of pad dresser 30 of a second prerequisite technology according to the present invention. Pad dresser 30A comprises mainly elastic member 31A and support part 32 which supports base end 31*a* of elastic member 31A. Tip terminal 33 has been fixed at tip part of 31*b* of elastic member 31A. Support part 32 is supported by pressure regulation means 34 which moves repeating contact and non-contact on polishing pad 20.

As elastic member 31A, a flat spring and a piano wire, etc. are preferably used. Tip terminal 33 fixed to tip part of 31*b* of elastic member 31A is preferably made from the high hardness abrasion resistance material where a diamond abrasive grain or DCL and a superhard, etc. are fixed by a method of an electrodeposition, CVD and coating, etc.

Figure 4:
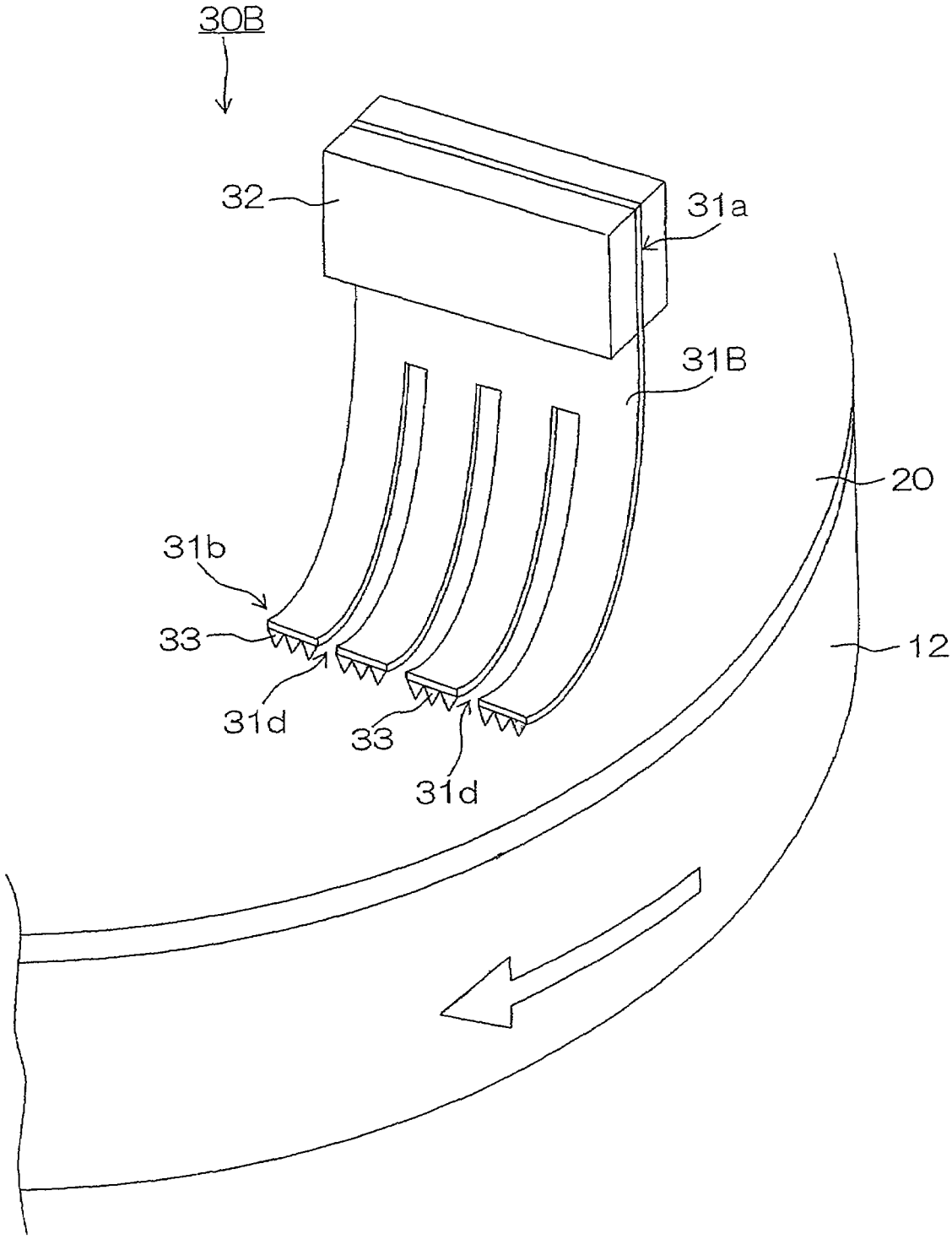
FIG. 4 is a conceptual diagram of pad dresser 30 of a third prerequisite technology according to the present invention.

FIG. 4 is a conceptual diagram of pad dresser 30 of a third prerequisite technology according to the present invention. As for pad dresser 30B in accordance with the third prerequisite technology, flat spring 31B of a lamella-shape as elastic member 31A is used.

In flat spring 31B, a plurality of cut out 31*d*, 31*d*, . . . are formed from tip part 31*b* towards base end 31*a* and tip part 31*b* is separated into a plurality of parts. Tip terminal 33, 33, . . . comprising the diamond abrasive grain, respectively, are electrodeposited at the tips of a plurality of the separated parts.

As mentioned above, as for the high hardness abrasion resistance material, DCL and a superhard, etc. other than the diamond abrasive grain can also be used, and as for the fixing method, CVD and a method by coating, etc. besides the plating such as the electrodeposition can also be used.

As shown in FIG. 4, pad dresser 30B is composed so that the dressing of the surface of polishing pad 20 may be performed by making tip terminals 33, 33, . . . generate a dressing pressure by the elastic deformation of flat spring 31B.

A shown in FIG. 4, since flat spring 31B is separated into a plurality of parts by a plurality of cut out 31*d*, 31*d*, . . . from the vicinity of the base end 31*a* toward a tip part of 31*b*, even if tip terminals 33, 33, . . . of each part perform intermittent contact respectively in terms of stick slip against polishing pad 20, as the overall flat-spring 31B, tip terminals 33, 33, . . . of some part always contact polishing pad 20, and the uniform pad dressing along the surface of polishing pad 20 is made.

Figure 5:
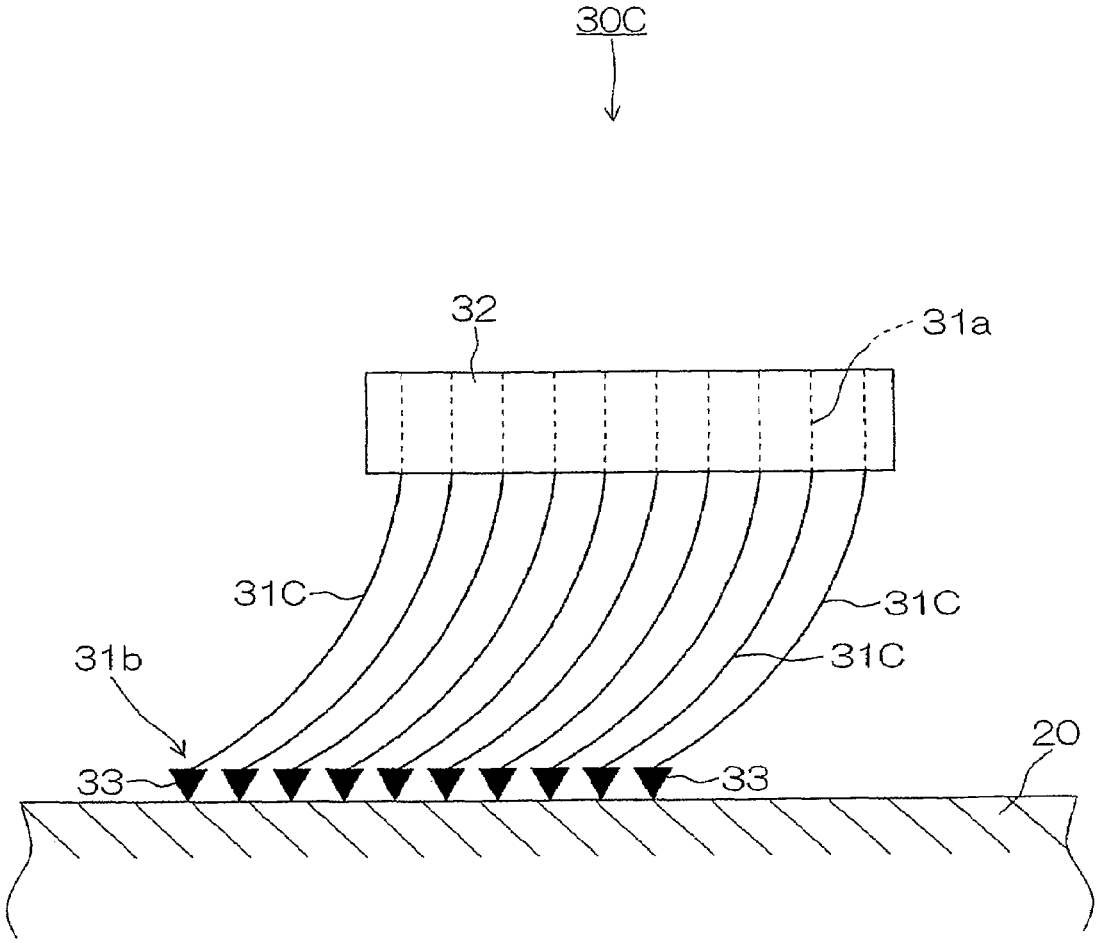
FIG. 5 is a conceptual diagram of pad dresser 30 of a fourth prerequisite technology according to the present invention.

FIG. 5 is a conceptual diagram of a pad dresser of a forth prerequisite technology accordance to the present invention. As for pad dressers 30C according to the fourth prerequisite technology, the aggregate (for example, brush-like aggregate) of piano wires 31C, 31C, . . . which are a plurality of streak materials are used as elastic member 31.

Base end 31*a* of piano wire 31C which is each streak material is fixed to support part 32, and tip terminal 33 comprising the diamond abrasive grain is electrodeposited at the tip part of 31*b*. Each tip terminal 33 contacts polishing pad 20 in the state where each piano wire 31C is deformed elastically as shown in FIG. 5, and a suitable dressing pressure is made to be obtained.

Since elastic member 31 is formed with the aggregate of piano wire 31C of which the each element wire is independent respectively, even if tip terminal 33, 33, . . . of each piano wire 31C performs intermittent contact respectively in terms of the stick slip on polishing pad 20 also in the forth embodiment, some of tip terminals 33, 33, . . . of a plurality of piano wires 31C, 31C, . . . always contact polishing pad 20 as the overall aggregate of a plurality of piano wires 31, 31C, . . . and a uniform pad dressing along the surface of polishing pad 20 is performed.

In the fourth prerequisite technology, piano wire 31C is used as the streak material, but it is not limited to the wire, and other materials such as the streak materials of a high modulus such as a glass fiber, resin, etc. for example, may be used. Since it is difficult to electrodeposit tip terminal 33 in the case of the material of the glass fiber, the resin, etc., tip terminal 33 is fixed by an adhesion, etc. in the case of such material, for example.

Figure 6:
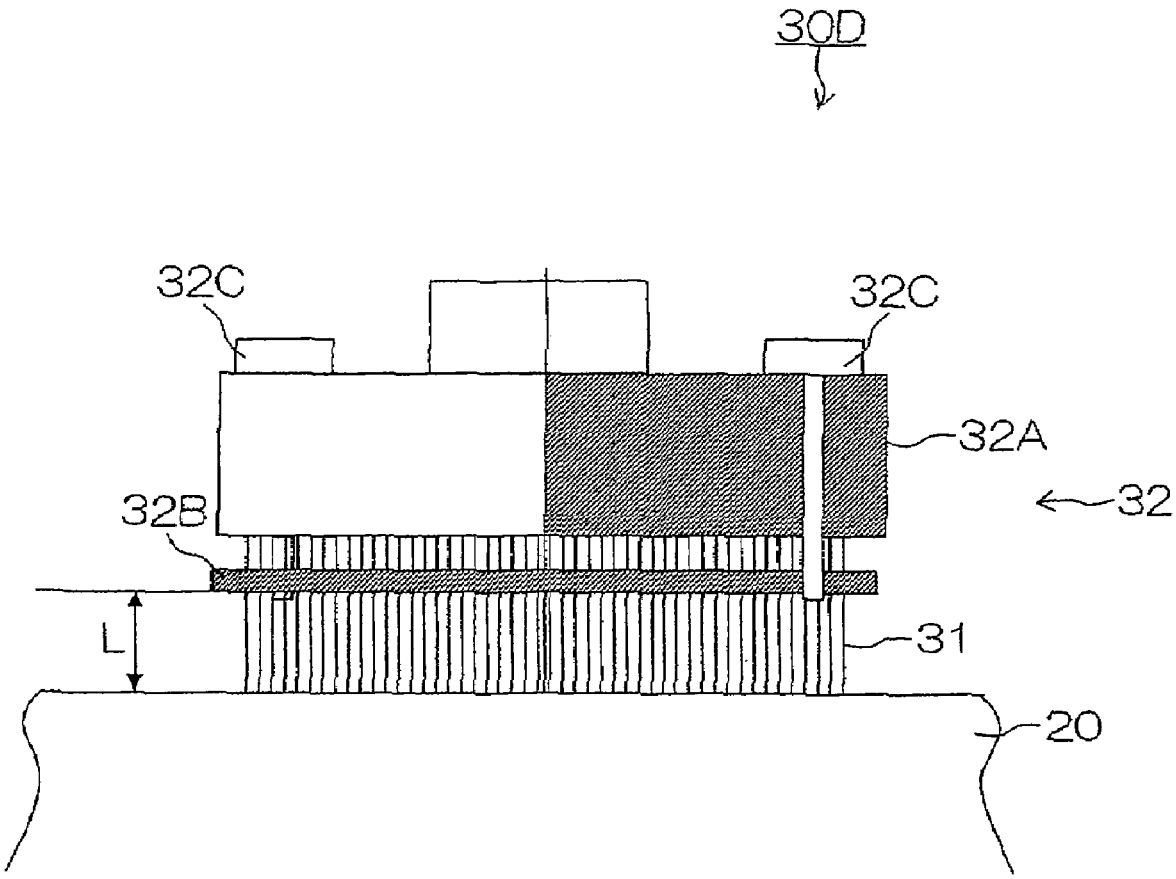
FIG. 6 is a conceptual diagram of pad dresser 30 of a fifth prerequisite technology according to the present invention.

FIG. 6 is a conceptual diagram of pad dresser 30 of a fifth prerequisite technology according to the present invention. As for pad dresser 30D according to the fifth prerequisite technology, support part 32 is divided into a first support member 32A and a second support member 32B.

The first support member 32A is a member which fixes each base end 31*a* of a plurality of elastic member 31, 31, . . . , and the second support member 32B has restricted a horizontal position of each elastic member 31 by a plurality of formed holes. The second support member 32B is supported adjustable in the distance to the first support member 32A so as to be near or away by a plurality of adjustable screw 32C, 32C, . . . and it has come to be able to carry out fine adjustment of the effective flexible length L of elastic member 31.

Since pad dresser 30D of the 5th prerequisite technology which is shown in FIG. 6 is formed in this way, adjustment of effective flexible length L of elastic member 31 is easy, and fine adjustment of dressing pressure P is performed easily.

Figure 2B:
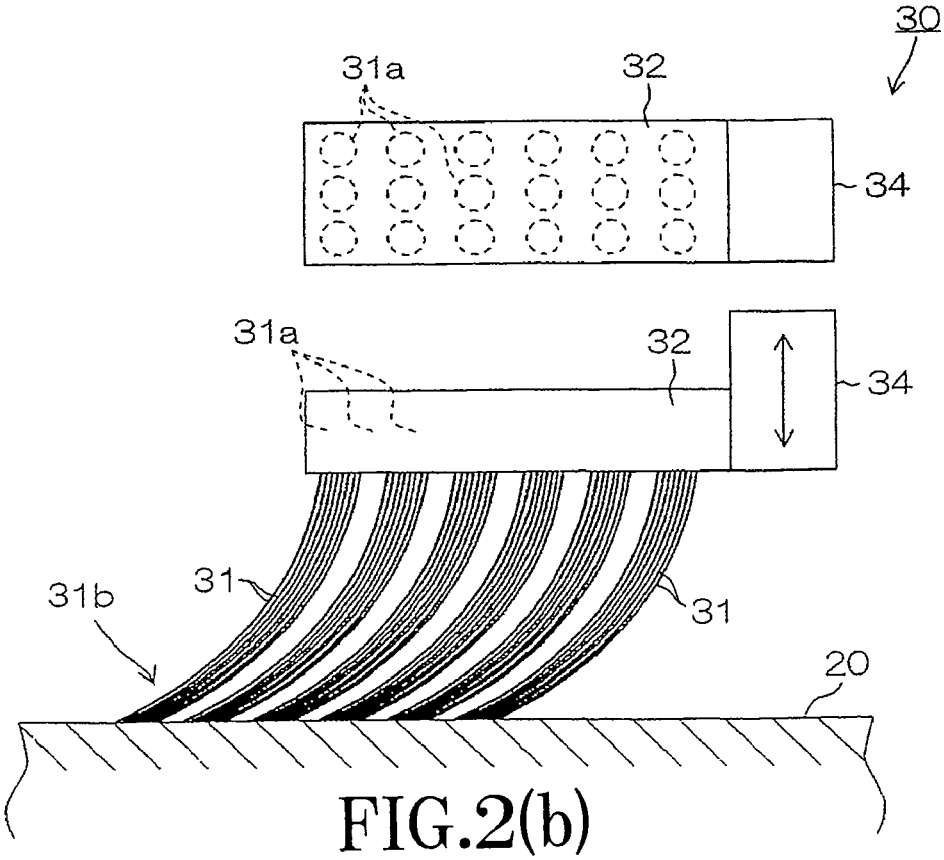

For elastic member 31 in the fifth prerequisite technology, any one of elastic member 31 shown in FIG. 2A and FIG. 2B or elastic member 31A shown in FIG. 3, elastic member 31B shown in FIG. 4, and elastic member 31C shown in FIG. 5 is usable preferably.

Figure 8:
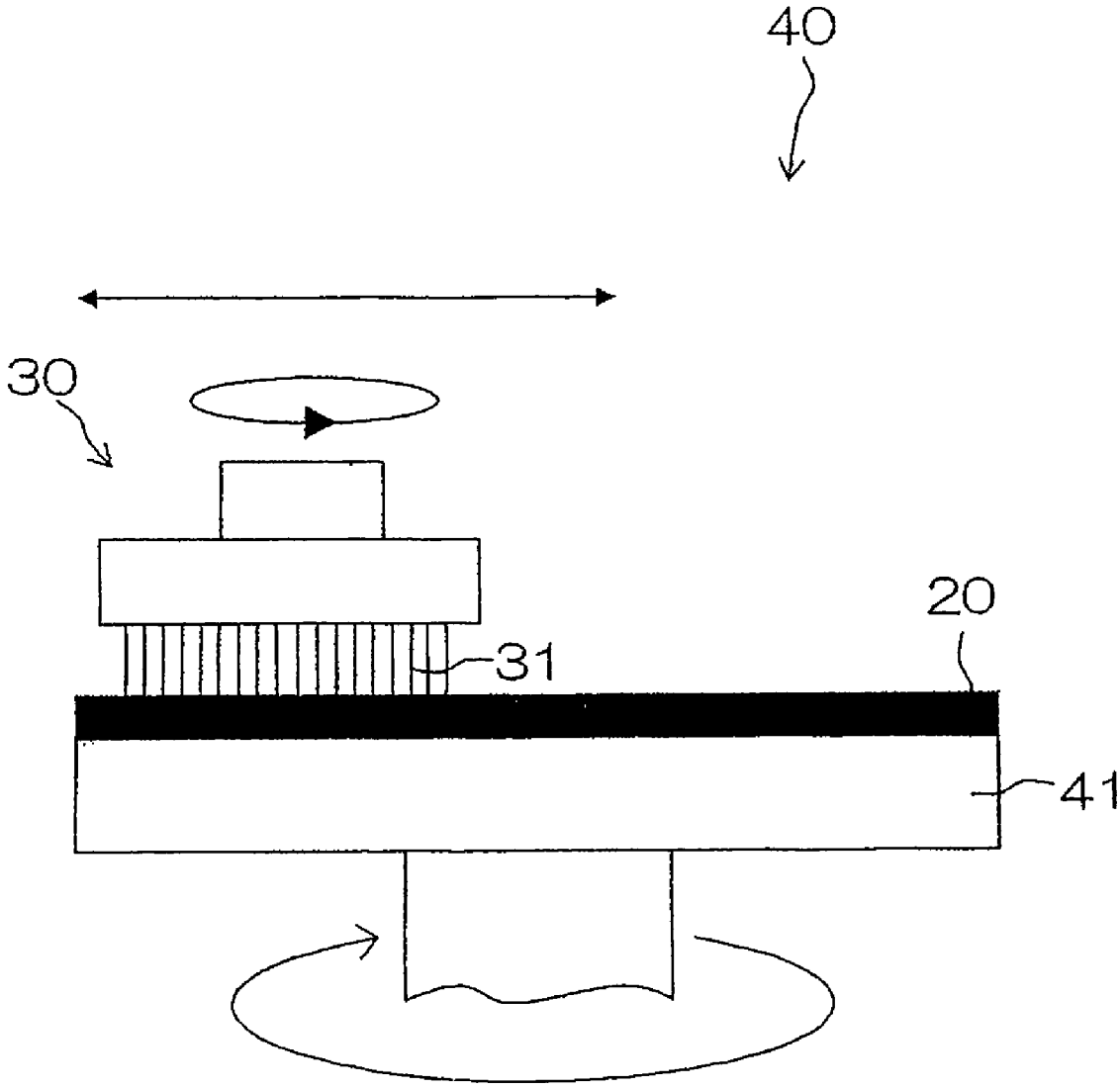
FIG. 8 is a diagram showing the pad pretreatment device for performing the dressing of the polishing pad 20 to initialize surface state which can be polished.

FIG. 8 shows a pad pretreatment device for performing dressing of the polishing pad 20 and initializing the surface into the state to be polished. Pad pretreatment device 40 comprises rotary table 41 which maintains polishing pad 20 and rotates, pad dresser 30, and a not shown feeder of water or slurry, etc.

Rotary table 41 has absorbing holes for absorbing and fixing polishing pad 20, and is rotated by a not shown motor. Pad dresser 30 mentioned above is provided, and polishing pad 20 and pad dresser 30 are made to rotate to contact each other, and the surface of polishing pad 20 is cut off minutely, and the surface-roughening of the surface of polishing pad 20 is performed. The polishing may be performed with supplying water to polishing pad 20 in order to make the surface of polishing pad 20 into a fine roughened surface.

As dressing conditions, for example, a foamed polyurethane pad is used as polishing pad 20, and is fixed to rotary table 41 by vacuum absorption. With 30 rpm as the number of rotations of polishing pad 20 and 80 rpm as the number of rotations of pad dresser 30, the processing is performed for the surface roughness Ra to be 0.4 μm to 0.6 μm.

Thus, since pad pretreatment device 40 is provided with pad dresser 30 mentioned above, the pad pretreatment device 40 can perform uniform pad dressing, and can initialize the surface state of polishing pad 20 to be a polishable state in a short time.

Next, a preferred embodiment of the pad dresser according to the present invention is described. An entire configuration of the pad dresser in the embodiment has configurations as shown in FIG. 2 to FIG. 6. By the following description, in order to avoid duplicated description, only the principal part according to the present invention is described, and also with respect to figures, only the principal part according to the present invention will be illustrated.

Figure 9B:
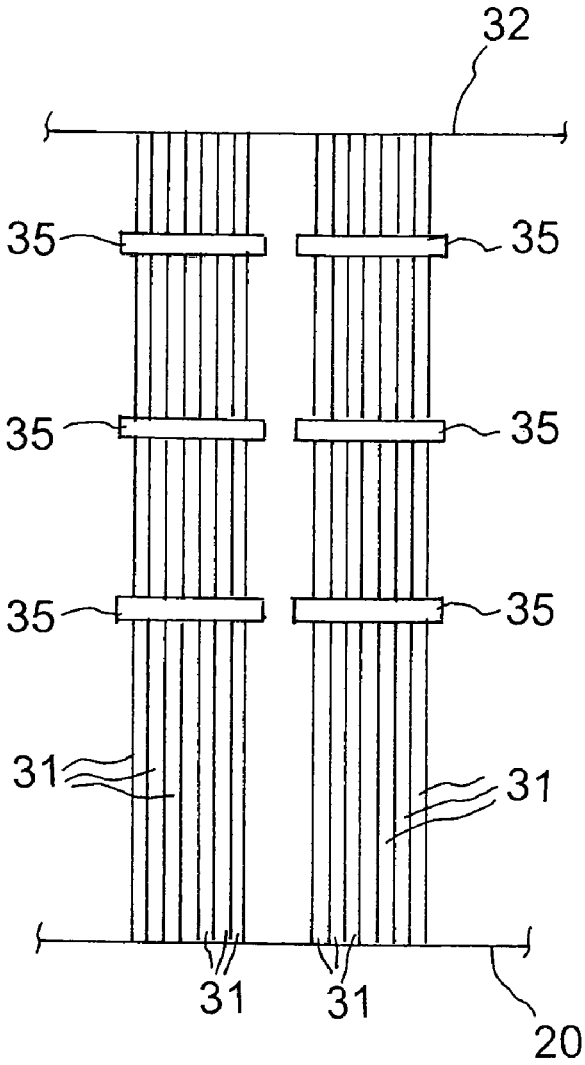
FIG. 9B is a cross sectional view.
Figure 9A:
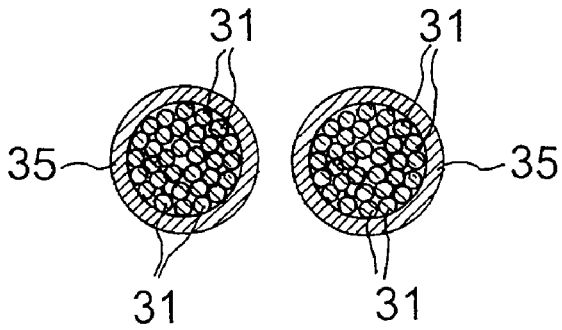
FIG. 9A is a side view.

FIG. 9 is a conceptual diagram of a pad dresser according to the first embodiment of the present invention. FIG. 9A is a side view and FIG. 9B is a cross sectional view. An end of elastic member 31 bundled by pencil band 35 is attached to a lower edge of support part 32. Elastic member 31 is composed with every 30 tungsten wires of 0.15 mm size and 25 mm length bundled in one bundle respectively. The tip part of each element wire of elastic member 31 is made to contact the surface of polishing pad 20 with a straight end without the abrasive grain attached, and perform dressing of polishing pad 20.

As shown in FIG. 9, while the wire size of the tip part of each element wire in elastic member 31 is made to be fine, and the cutting width on polishing pad 20 is made to be narrow, the rigidity of elastic member 31 is made to be high by bundling each element wire of elastic member 31 together by pencil band 35 and is made to produce a large pressure at the fine tip part of each element wire.

Elastic member 31 composed like this by bundling many fine element wires (metal wire) is generally called a fiber dresser. While a rake angle is −60° to −80° in the case that an ordinary diamond dresser cuts a polishing pad, the rake angle can be made to be −10° to −30° by using the fiber dresser. Therefore, even if the tip of each element wire of the fiber dresser becomes blunt, an effective incision depth can be given to polishing pad 20.

Figure 10:
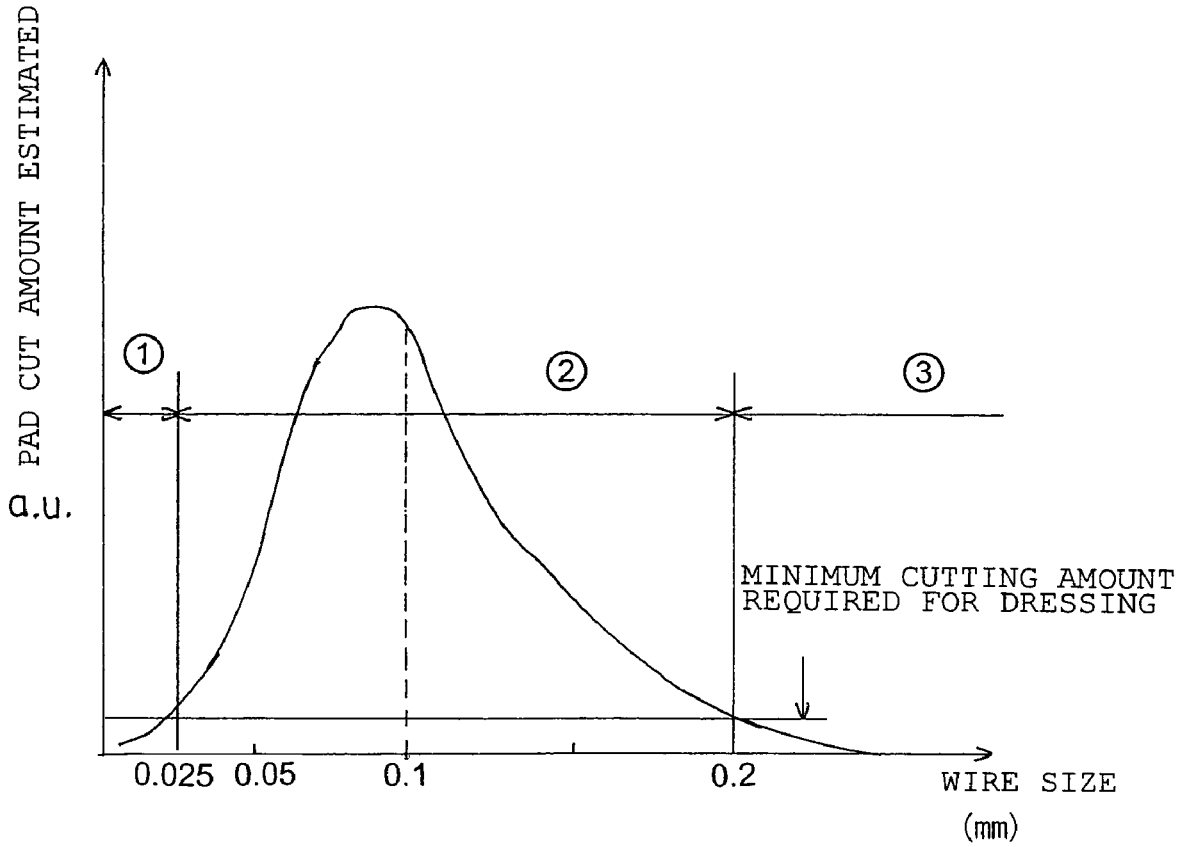
FIG. 10 is a characteristics view showing a relation between a wire size of each element wire and a pad cutting amount in a fiber dresser.

Here, the optimal wire size of each element wire of elastic member 31 which composes the fiber dresser is described. FIG. 10 is a characteristics figure showing a relation between a wire size of each element wire and the pad cutting amount in the fiber dresser. The wire size of each element wire is expressed in the horizontal axis, and the estimated pad cut amount is expressed in the vertical axis. Material of the element wire at this time is SUS304, and the pressing load to polishing pad 20 by elastic member 31 is 3 kgf.

As shown in FIG. 10, when a wire size of the element wire is 0.025 mm or less in diameter, even if elastic member 31 is composed by bundling element wires, the tip part is deformed because the wire size of each element wire is fine, and therefore, an effective incision depth (pad cutting amount) cannot be given to the polishing pad. Since the element wire is too fine and it is easy to generate a breaking of wire of the element wire, etc., it is not desirable from the aspect of quality control.

Next, while the wire size of the element wire is between 0.025 mm and 0.2 mm in diameter, the diameter of the tip part also becomes small corresponding to that. Therefore, since cutting width which cuts polishing pad 20 is narrow enough as compared with the traditional diamond dresser, a minute cut can be performed on polishing pad 20. Overall deflection rigidity of elastic member 31 can be made to be large by bundling wire rods of the wire size in the above-mentioned range, and even if the tip part is fine, the sufficient incision depth (pad cutting amount) can be given on polishing pad 20.

Within the range of such a wire size, even if the tip of each element wire becomes blunt and round, the stable incision can be given on polishing pad 20 because the size of each element wire is fine. As a result, it becomes possible to perform the stable dressing of the polishing pad 20 continuously.

Next, when the wire size of each element wire is not less than 2.2 mm, deflection rigidity of elastic member 31 can be enlarged by bundling each element wire, but since the tip of each element wire becomes thick, it becomes difficult to give sufficient incision depth (pad cut amount) on polishing pad 20. That is, although the pad dressing is possible at the sharp tip of an early phase, once the tip becomes round because of blunting according to abrasion, it becomes impossible for each element wire to give the effective incision depth on polishing pad 20. Since polishing pad 20 will be cut by an excessive pressure, polishing pad 20 is cut so as to be plucked, and as a result, the removal rate decreases.

Figure 11A:
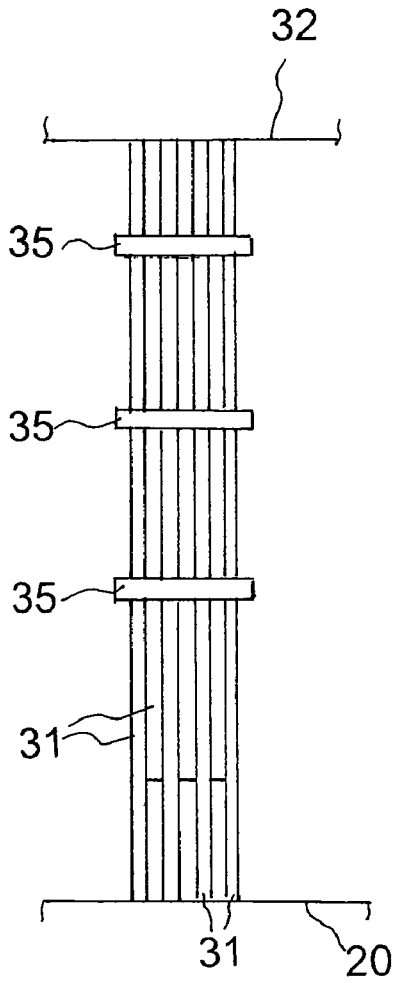
FIG. 11A is a side view.
Figure 11B:
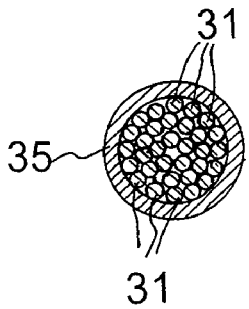
FIG. 11B is a cross sectional view.

Next, as the second embodiment, the pad dresser of a configuration having bundled the element wires of which length differs is described. FIG. 11 is a conceptual diagram of the pad dresser according to the second embodiment of the present invention. FIG. 11A is a side view and FIG. 11B is a cross sectional view.

As shown in FIG. 11, although each element wire is bundled in order to secure the deflection rigidity, elastic member 31 is composed so that the element wire which abuts polishing pad 20 and the element wire which does not abut the pad exist. Here, although the element wire which abut polishing pad 20 is an elastic body, the element wire which does not abut polishing pad 20 may not be the elastic body.

That is, even if the rigidity of elastic member 31 is enhanced by bundling each element wire, when the tip part of all the element wires abut to polishing pad 20, if each element wire is close to each other excessively, the effective incision depth for cutting polishing pad 20 at the tip part of each element wire cannot be obtained. Furthermore, the swarf of the polishing pad 20 stays at the gap between the tip parts and is not ejected.

Then, a part of element wires are kept from abutting polishing pad 20 among the element wires, as shown in FIG. 11. By this, while the rigidity as elastic member 31 is secured, the tip part of the element wires can operate on polishing pad 20 properly, and can perform sufficient incision. Since the gap between the element wires abutting polishing pad 20 is secured properly, it can be made to eject the swarf without clogging therebetween.

Figure 12A:
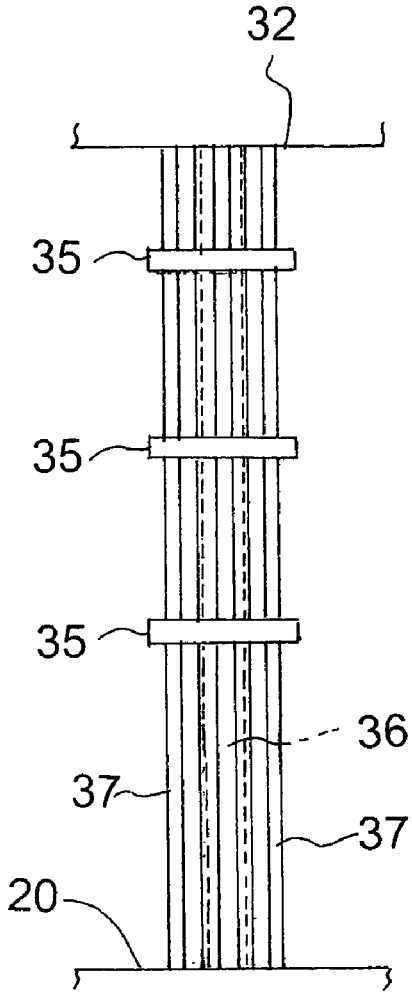
FIG. 12A is a side view.
Figure 12B:
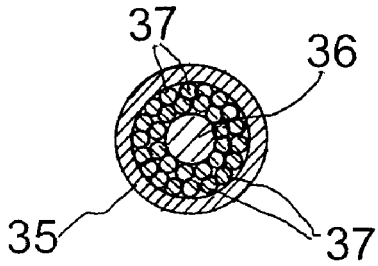
FIG. 12B is a cross sectional view.

Next, as the third embodiment, a configuration of the pad dresser which has a deflection reinforcing member inserted into the bundle of each element wire is described. FIG. 12 is a conceptual diagram of the pad dresser according to a first one of the third embodiment of the present invention. FIG. 12A is a side view and FIG. 12B is a cross sectional view.

As shown in FIG. 12, thick reinforcing member 36 with the length which does not abut polishing pad 20 is inserted in a center portion of the bundle of the element wires, and flexible wire rod 37 of the elastic body which abuts polishing pad 20 and carries out dressing is disposed in the outer circumference thereof. As for such flexible wire rod 37, the bundle of the fine element wires is used as mentioned above.

By the configuration of the pad dresser as shown in FIG. 12, since the rigidity is able to be enhanced by reinforcing member 36 of the center portion, and at the same time, flexible wire rod 37 comprising the bundle of the surrounding fine element wires abuts polishing pad 20, the dressing of the polishing pad 20 can be continuously performed by the tip of flexible wire rod 37.

Figure 13:
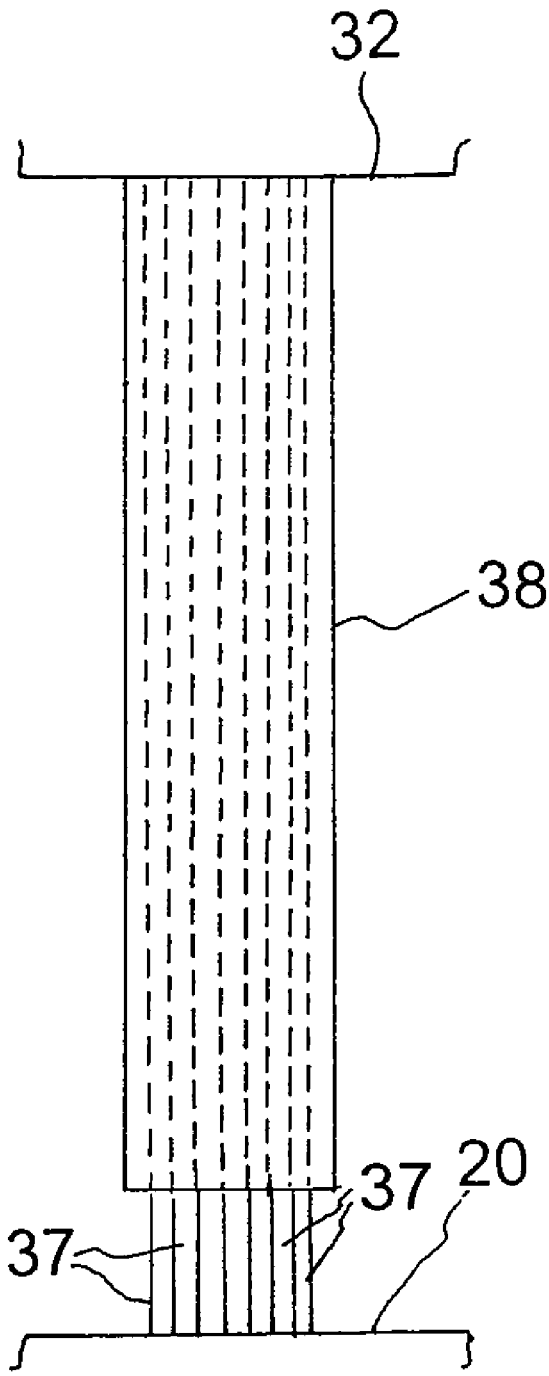
FIG. 13 is a conceptual diagram of the pad dresser according to a second of the third embodiment of the present invention.

FIG. 13 is a conceptual diagram of the pad dresser according to a second one of the third embodiment of the present invention. As shown in FIG. 13, in order to enhance the rigidity, flexible wire rod 37 of the fine element wires is bundled and is inserted into flexible tube 38. By this, the deflection rigidity is enhanced by the outer circumference tube 38, and the tip of flexible wire rod 37 of the fine element wires operates on polishing pad 20 effectively. The fine element wires can be protected from scattered slurry for polishing, etc. with tube 38 of the outer circumference.

Figure 14A:
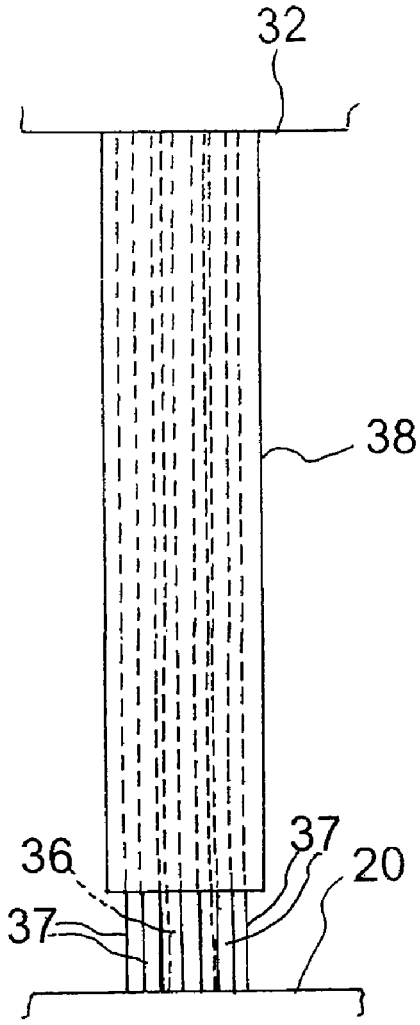
FIG. 14A is a side view and FIG. 14B is a cross sectional view.
Figure 14B:
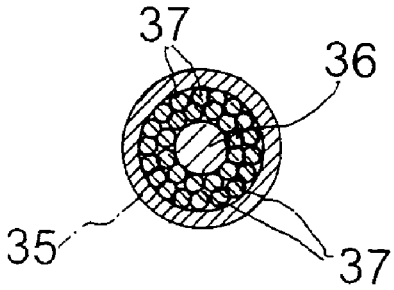

FIG. 14 is a conceptual diagram of the pad dresser according to a third one of the third embodiment of the present invention. FIG. 14A is a side view and FIG. 14B is a cross sectional view. As shown in FIG. 14, reinforcing member 36 is inserted in an inner part of flexible wire rod 37 of the fine element wires, and the rigidity can be enhanced. That is, fine flexible wire rod 37 is used as a cylinder, and reinforcing member 36 is put in the inside thereof so that it may not abut polishing pad 20, and tube 38 is rolled on the outside thereof, and with restraining the deflection thereby, the element wires of flexible wire rod 37 is made to abut polishing pad 20 and the dressing is performed.

That is, according to the pad dresser of the present invention, by using the elastic member with two or more fine wires packed and bundled together, even if each element wire is fine, it becomes possible to obtain the sufficient elastic strength. Thereby, the following specific operation effects can be provided. That is, since the elastic member with a plurality of element wires bundled together is made of the fine material, the element wire also with the fine tip part abuts the polishing pad. The elastic material at this time (that is, the bundle of the element wires) blunts immediately, because the elastic material has no abrasion resistance like a diamond.

However, even in the case of the tip part of the blunted element wire, by using the element wire as the elastic member bundled together, the very large bending rigidity can be acquired and the amount of incision for cutting the polishing pad can fully be obtained. As the result, it becomes possible to perform a stable pad dressing regardless of blunting of the tip part of the element wires.

That is, in a diamond dresser of the traditional disk type, since the diamond itself is of a regular-tetrahedron structure, the enough embedding amount is indispensable for preventing the falling of the diamond. Usually, as for the amount of embedding of the diamond, it is desirable for there to be not less than 70%. Therefore, the rake angle for cutting the polishing pad with the diamond becomes large minus, and becomes −60° to −80°, for example.

On the other hand, in the case of using the elastic member with the element wires bundled like the present invention, if the elastic member contacts the polishing pad to such the extent that the tip of the element wires is deformed slightly without inclining the elastic member to the surface position of the polishing pad, it is possible for the elastic member to be made into having the rake angle of −10° to about −30°. Therefore, even if there is no sharpness in the tip end part of the elastic member, it becomes possible to cut the polishing pad effectively.

In the elastic member of the present invention, the cutting width on the polishing pad can also be made narrow. For example, in the case of that the element wire (wire) of 0.1 mm in a wire size is bundled and is used, each cutting width becomes 0.1 mm or less. In the traditional diamond dresser, it is difficult to make the cutting width narrow to this extent.

This is because when the particle diameter of the diamond itself is made small, the amount of embedding the diamond for maintaining enough without falling cannot be secured and the berry drop of the diamond will happen. Therefore, in the diamond dresser, a very fine diamond cannot be used and generally the diamond of #100 (mean-particle-diameter 170 μm) is used at most.

On the other hand, in the case of using the wire-like elastic member like the present invention, there is no possibility of the berry drop like the traditional diamond dresser. Even if the tip part of the elastic member wears out, since the detachment by forming the agglomerate like the diamond will not occur, there is no possibility of bringing about the effect harmful to the wafer surface.

As mentioned above, in the case of using the element wires of fine wire size having about 0.1 mm, for example, the cutting width can be made to be 0.1 mm or less, and it becomes possible to configure the rake angle for cutting the polishing pad to be small as much as possible (for example, about −10°). Conjointly because of such small cutting width and not becoming the negative large rake angle compared conventionally, it becomes possible to perform dressing of the polishing pad stably.

Figure 15:
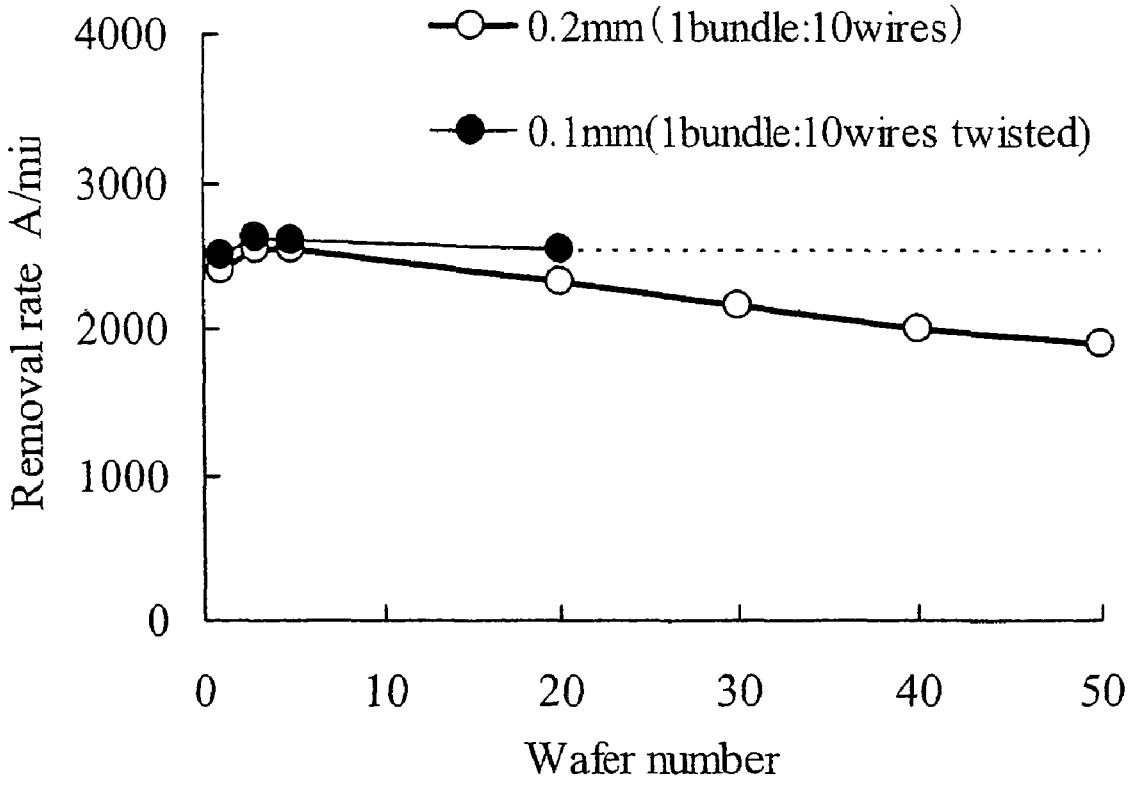
FIG. 15 is a characteristics view of an experimental result showing a removal rate when performing dressing by an elastic member using element wires of which wire size differs.

Next, an experimental result about the stability of the removal rate when performing dressing with the elastic member using the element wires of which wire sizes differ is described. FIG. 15 is a characteristics view of the experimental result showing the removal rate when performing dressing by the elastic member using the element wire of which the wire size differs, the horizontal axis expresses the wafer number and the vertical axis expresses the removal rate. Each experiment was conducted using a brush-shaped dresser (elastic member) manufactured by SUS304.

A dresser (elastic member) A having the element wire of the wire size of 0.2 mm was manufactured to have the shape where each ten element of wires were bundled. On the other hand, a dresser (elastic member) B having the element wire of the wire size of 0.1 mm was manufactured to have the shape where, after bundling each ten element of wires, the wire rods of those element wires were twisted and loosened from the tip part to the position at around 5 mm therefrom.

As for slurry, commercially available fumed silica slurry SS25 (made by Cabot) (registered trademark) was diluted with water in a ratio of 1:1 and was used, and as for a polishing pad, commercially available foaming polyurethane pad IC1400-XYGroove (made by Nitta-Haas) (registered trademark) were used. In addition, the experiment was performed on the condition that number of rotations of the platen is 80 rpm, and the polishing pressure is 28 kPa. As for a wafer, the wafer where plasma silicon oxide film was formed on a silicon wafer was used.

As shown in FIG. 15, in a pad dresser (elastic member) whose wire size of the element wire is 0.2 mm, the sharpness at the tip is dominant in the pad dressing, and the removal rate reduces quickly in connection with wearing out of the wire top end with dressing.

On the other hand, the pad dresser (elastic member) whose wire size of the element wire is 0.1 mm shows possibility that the stable removal rate will be obtained during a long period of time, as compared with the dresser (elastic member) whose wire size of the element wire is 0.2 mm. At this time, although the wire top end blunts by the abrasion, even if it blunts, since the cutting width itself is narrow, the stable incision depth can be obtained and it is shown that the stable dressing capability is maintainable regardless of the shape of the wire top end.

Next, an evaluation result with respect to a life of the pad dresser is described. In the traditional pad dresser, the sharpness of the diamond tip part was dominant in the pad dressing capability. In the case of the tip part blunting, even if extrusion of the abrasive grain is made to be extremely large, the pad dressing capability is not recovered.

Reference: Takashi Fujita and Junji Watanabe: "Development of a long lasting pad dresser—Stabilization of the number of dressing effective abrasive grains—", Journal of Japan Society for Abrasive Technology, p. 147, No. 3, Vol. 48.

In the pad dressing according to such a traditional diamond dresser, when a diamond tip part blunts and it becomes round, it will become impossible to give incision to the pad and it will only be considered that the pad dresser is just scrubbing and smoothing the pad surface.

On the other hand, in the flexible pad dresser which is made as a prototype based on the embodiment, since the material at the tip has no antifriction material to the extent of the diamond, the life of the pad dresser being still shorter is concerned.

Then, the long-term pad cut amount was tested with the pad dresser which was made as a prototype this time based on the content of the above-mentioned embodiment. In the test at this time, the pad dresser was made to stay on an inner circumference of the polishing pad, and an acceleration evaluation was performed.

Figure 16:
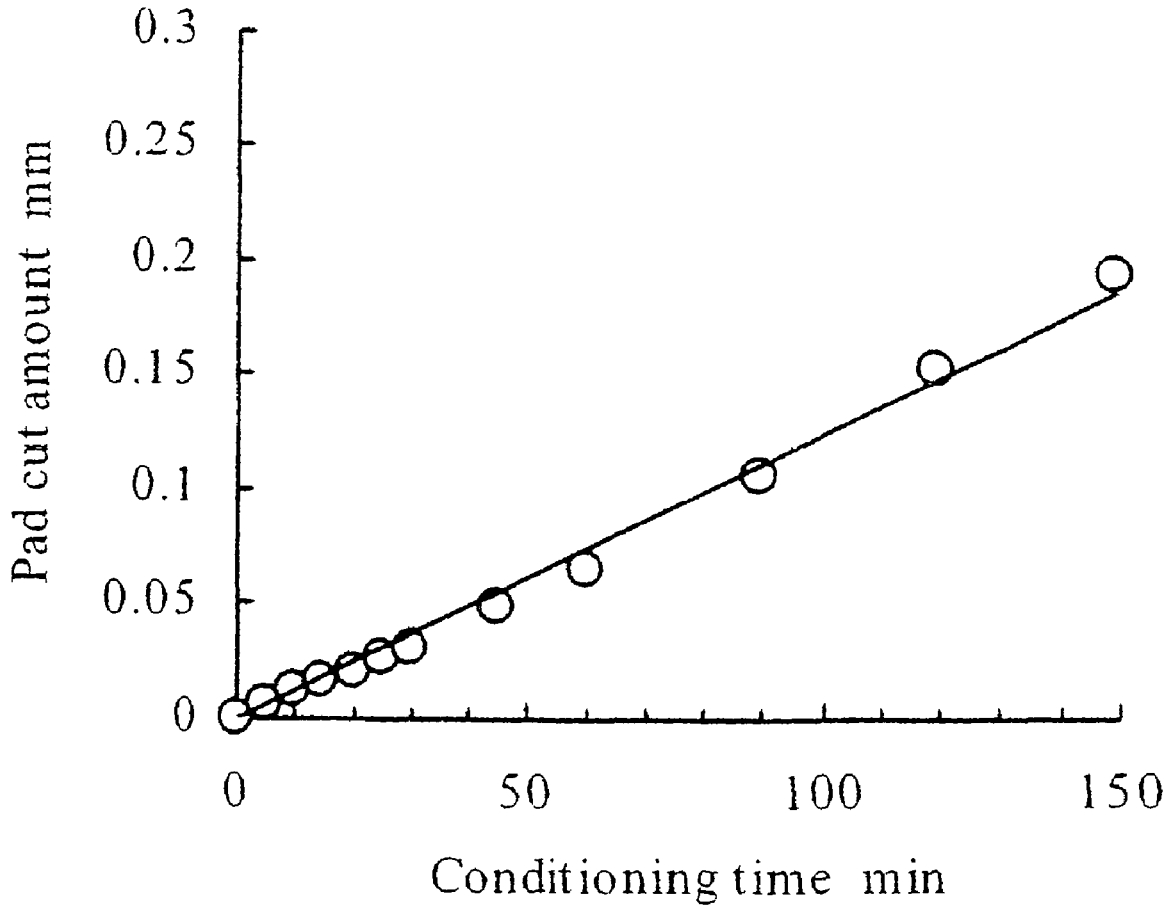
FIG. 16 is a characteristics view showing a time dependency of the pad cut amount.

FIG. 16 is a characteristics view showing the time dependency of the pad cutting amount where the horizontal axis expresses the conditioning time (minute) and the vertical axis expresses the pad cut amount. As shown in FIG. 16, the pad cut amount is increasing in proportion to the conditioning time of the polishing pad. After finishing of the cutting test, in spite of the tip part of the fiber dresser's wire rod (SUS304) has blunted, the sufficient pad cutting capability has been maintained.

Figure 17B:
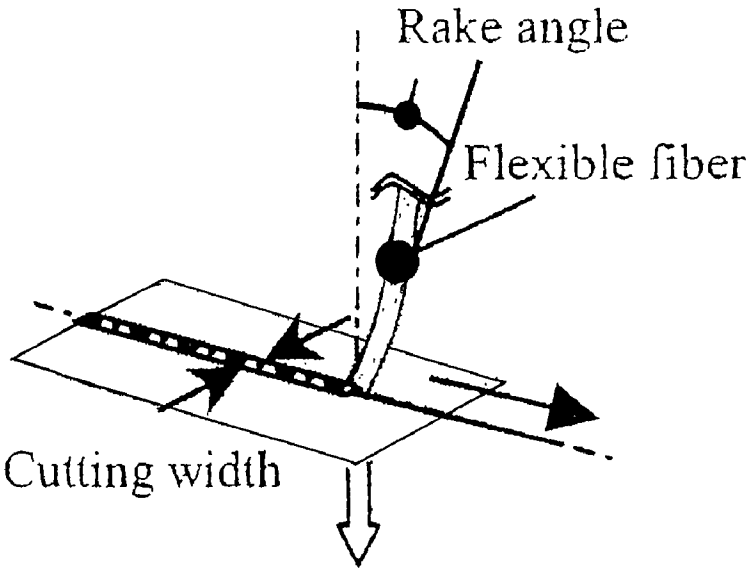
FIG. 17 is a conceptual diagram showing a distinction in the pad cutting state between a traditional diamond dresser and the fiber dresser of the present invention.
Figure 17A:
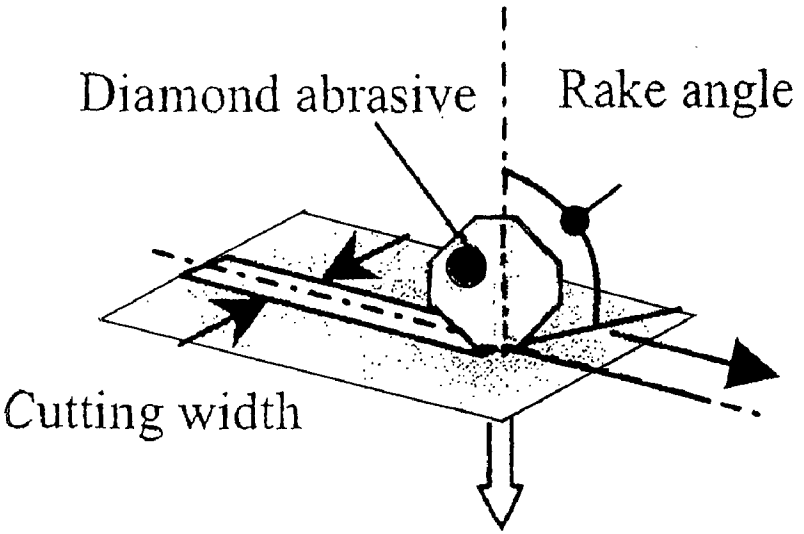
Figure 18:
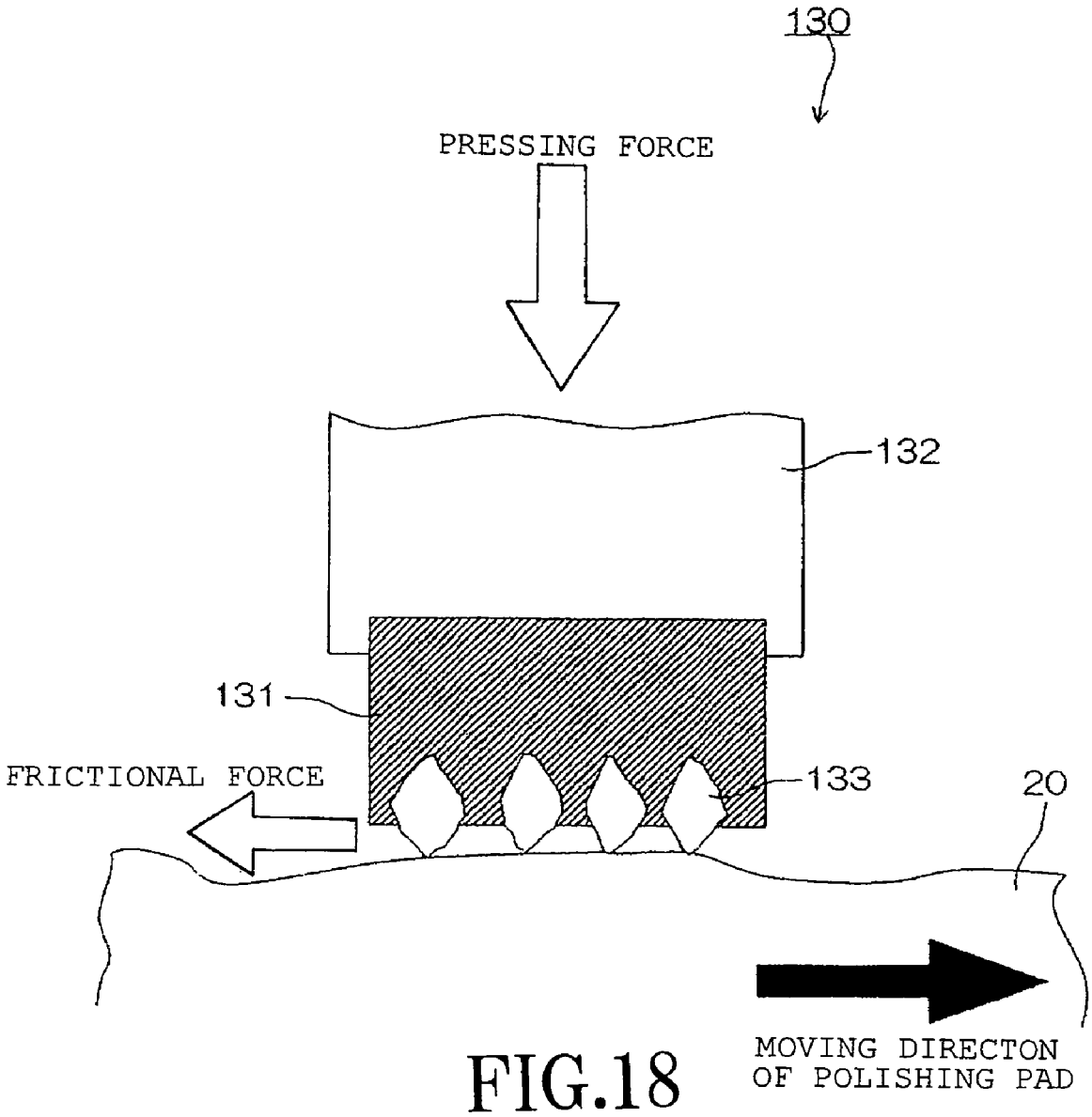
FIG. 18 is a conceptual diagram showing a configuration of the traditional pad dresser.
Figure 19:
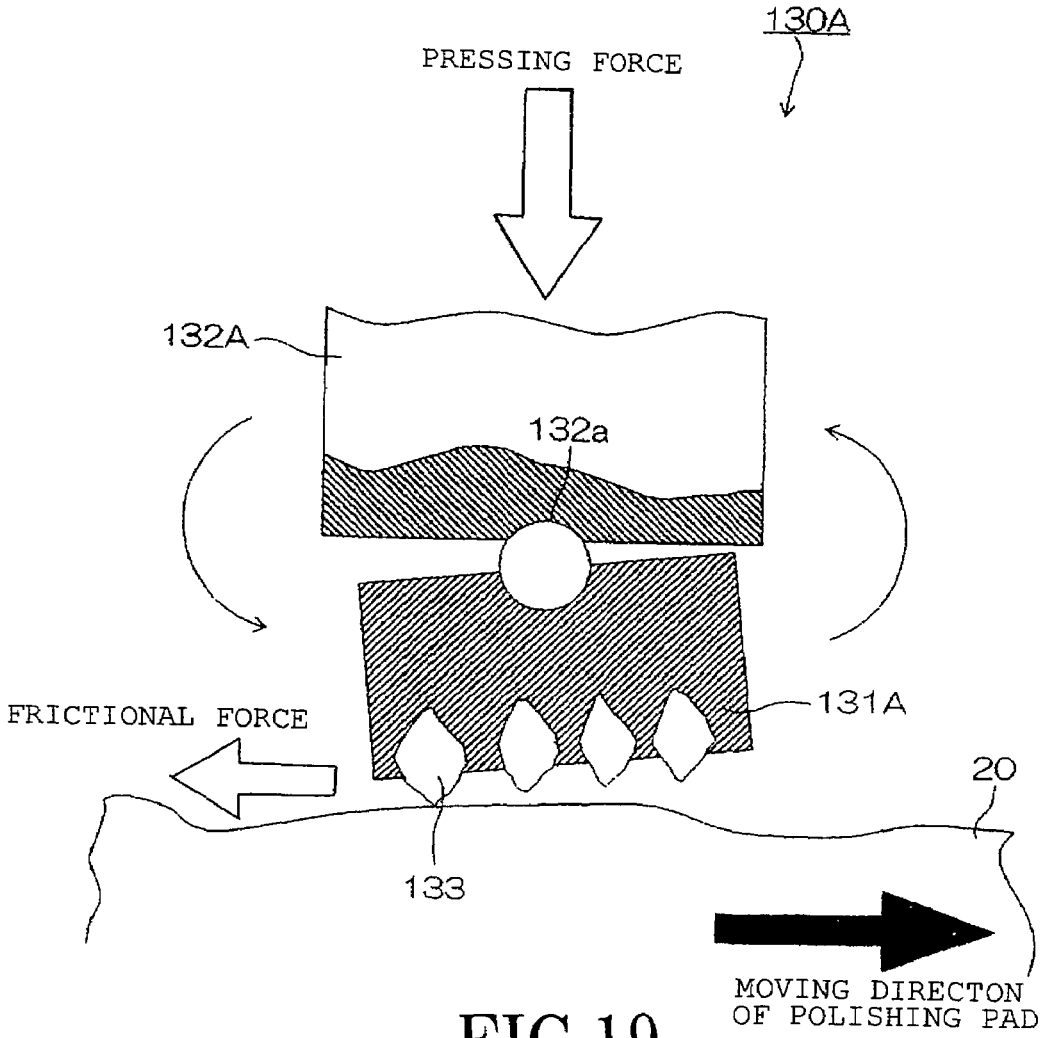
FIG. 19 is a conceptual diagram showing another configuration of the traditional pad dresser.
Figure 20:
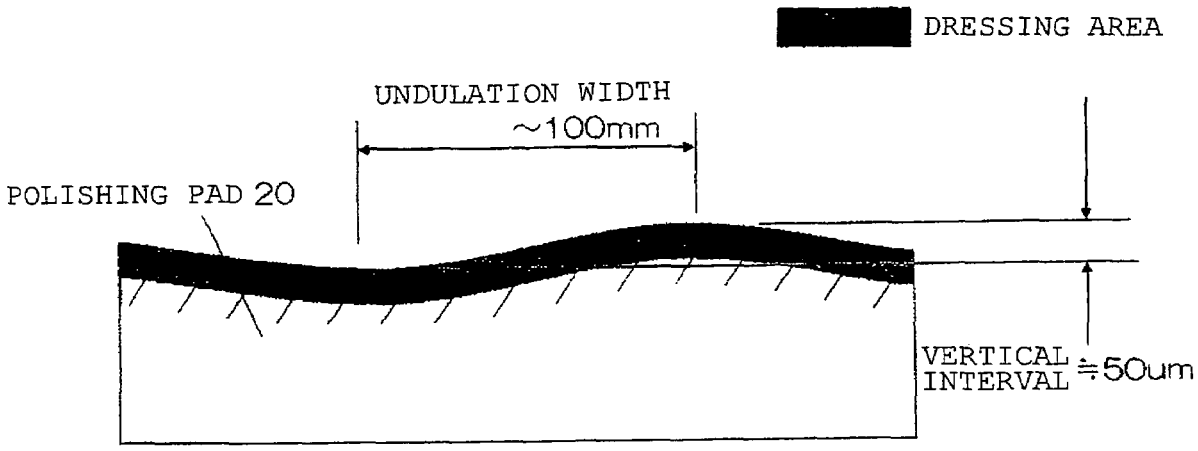
FIG. 20 is a diagram showing a concept of the specification of pad dressing required of CMP.

FIG. 17 is a conceptual diagram showing a distinction in the pad cutting state between the traditional diamond dresser and the fiber dresser of the present invention.

As shown in FIG. 7A, in the traditional diamond dresser, the tip of the diamond contacted the pad with the small rake angle (for example, rake angle of from −70 to −80°). Even in this case, since the cutting part became local and the substantial cutting width became narrow in the case of the sharp tip part, it was possible to cut the pad. However, when the diamond at the tip wear out, the substantial contact region becomes large and the cutting width expands, and besides, when cutting the pad, the rake angle formed when the diamond contact the pad also becomes still larger, or depending on the case, the tip part may be continuously roundish to the extent that the substantial rake angle cannot be defined.

In contrast with this, in the flexible dresser (fiber dresser) of the present invention, as shown in FIG. 7B, by bundling a plurality of the flexible element wires together, the sufficient dressing pressure under the sufficient rigidity is secured.

Further, by using the fine element wire, even if the tips blunt, since the cutting width becomes narrower than the diameter of the element wire, the small cutting width is secured. Even if the tip blunts, the element wire itself is made to be bundled together, and without making the tip contact the pad with the element wire comparatively inclined, by making the tip contact the pad comparatively with the state of the vertical direction to such an extent that the tip part contacts the pad, it becomes possible to obtain a comparatively large rake angle (for example, rake angle of −10°) compared with the diamond. As a result, even if the tip part blunts by abrasion, it will become possible to have the extremely prominent operation effect which cuts the polishing pad properly regardless of the sharpness at the tip, compared with a conventional method.

Thus, the case that cutting and grinding progress even if the tip part wears out and blunts has not almost existed in the usual metal grinding and the grinding of ceramics, etc. This is based on that the sharpness of the tip part is essential in order to obtain the effective incision amount for grinding since metals or ceramics have extremely high hardness. However, like the pad for the polishing, in the case of that the material is composed by resin and moreover, by the specific material formed by foaming in order to increase the retentivity of the slurry, or in the case of a material containing the material of fiber in order to raise percentage of water retention, etc., such as polyester fiber, the hardness of the material itself of the pad becomes very small compared with metal, ceramics, etc. Therefore, even if the vicinity of the tip of the dresser sometimes blunts to a small extent, when the tip part of the wire-like material (element wire) is pressed in by a certain amount of strength, the tip part cuts into the material and the effective incision depth is obtained. As the result, it becomes possible to cut the material (here, pad) efficiently and continuously regardless of the sharpness of the tip part of the wire-like material.

The present invention is realized for the first time by the following configuration wherein, while utilizing the characteristic of the specific material of the pad for the polishing like this, the tip part of the elastic material is made to follow the pad, and at the same time, the elastic deformation part compresses each tip part on the pad strongly based on certain strength rigidity, and the tip part cuts the material, and each gap among the tip parts is rationalized in order to obtain the still more effective incision depth.

It is noted that various modifications may be made to the present invention without departing from the spirit or scope thereof and that the present invention covers the modifications.

[Description of Reference Numerals]

10: POLISHING DEVICE
20: POLISHING PAD
30, 30A, 30B, AND 30C: PAD DRESSER
31: ELASTIC MEMBER
31B: FLAT SPRING (ELASTIC MEMBER)
31C: PIANO WIRE (STREAK MATERIAL, ELASTIC MEMBER)
31A: BASE END
31B: TIP PART
31D: CUT OUT
32: SUPPORT PART
32A: FIRST SUPPORT MEMBER
32B: SECOND SUPPORT MEMBER
33: TIP TERMINAL
34: PRESSURE REGULATION MEANS
35: PENCIL BAND
36: REINFORCING MEMBER
37: FLEXIBLE MEMBER
38: TUBE
40: PAD PRETREATMENT DEVICE
41: ROTARY TABLE

What is claimed is:

1. A pad dresser and a pad dressing mechanism for roughening and processing a surface of a work, comprising:

a dresser for dressing the surface of a pad which is fixed and supported on a platen, the dresser further comprising;

an elastic member including a plurality of element wires having a tip part for cutting the surface of the polishing pad, the elastic member further comprising:

a band so as to constrain a plurality of element wires by means of bundling the plurality of wires together;

a plurality of bundles formed by bundling the plurality of element wires by said band;

a support part fixed and supported said plurality of bundles so as to be nearly parallel with the polishing pad and opposed thereto;

the tip part abutting the pad and cutting and roughening the pad surface; and an elastic deformation part for the tip part to follow and contact the surface of the pad with a constant pressure, the pressed elastic member cuts and roughens the surface of the polishing pad, and at the same time, dressing of the polishing pad is performed uniformly along the shape of the surface of the polishing pad.

2. A polishing device for polishing a work, comprising:

a pad fixed and supported on a platen;

a wafer holding mechanism for holding a wafer; and a dresser for dressing a surface of a pad, the dresser further comprising:

an elastic member including a plurality of element wires having a tip part for cutting the surface of the polishing pad, the elastic member further comprising:

a support part fixed and supported so as to be nearly parallel with the polishing pad and opposed thereto;

the tip part abutting the pad and cutting and roughening the surface of the pad; and an elastic deformation part for the tip part to follow the surface of the pad and contact the pad with a constant pressure, the elastic deformation part further comprising:

an effective length for performing the elastic deformation; and constraint means, placed between said support part and the tip part, constrained so as to restrain the elastic deformation with respect to the elastic deformation part of the plurality of element wires, wherein the support part moves relatively against the polishing pad, and at the same time, the tip part of the elastic member is made to abut the polishing pad and the elastic member performs elastic deformation, and thereby the tip part is pressed on the surface of the polishing pad by a predetermined pad dressing pressure and, the pressed elastic member cuts the surface of the polishing pad, and at the same time, dressing of the polishing pad is performed uniformly along the shape of the surface of the polishing pad.

3. The pad dresser according to any of claim 1 or 2, wherein, in the elastic member comprising a plurality of the element wires, the elastic deformation part performing elastic deformation is constrained so as to restrain the elastic deformation, and the tip part in contact with the polishing pad and the vicinity thereof are composed so that the restrained condition may be released compared with the upper part thereof.

4. The pad dresser according to claim 1, wherein the plurality of element wires of the elastic member are twisted.

5. The pad dresser according to claim 1, wherein the plurality of element wires of the elastic member are formed with metallic wires.

6. The pad dresser according to claim 5, wherein each wire size of the plurality of element wires of the elastic member is 0.025 mm or more and 0.2 mm or less in the diameter.

7. The pad dresser according to claim 1, further comprising:

pressure regulation means for adjusting the pad dressing pressure by making the support part move with contact and non-contact on the polishing pad, and by adjusting the deflection amount of the elastic member.

8. A polishing device provided with the pad dresser according to claim 1.

9. A pad dressing method for roughening and processing the surface of a polishing pad used for a polishing device polishing a work, comprising the steps of:

using the pad dresser according to claim 1;

making the polishing pad and the pad dresser perform a relative motion while making the pad dresser abut the polishing pad; and performing pad dressing while supplying pure water or slurry.

10. A pad dresser for roughening and processing a surface of a polishing pad comprising:

a support part positioned over the surface of the polishing pad;

a plurality of wire bundles having a proximal end attached to said support part and a distal end positioned for contacting the surface of the polishing pad; and a plurality of bands circumscribing and forming each of said plurality of wire bundles, said plurality of bands spaced between the proximal end and the distal end of said plurality of wire bundles, whereby said plurality of wire bundles provide bending rigidity facilitating stable pad dressing even when tips on the distal end of said plurality of wire bundles become blunt.

* * * * *